US007461911B2

(12) United States Patent
Hamazaki

(10) Patent No.: US 7,461,911 B2
(45) Date of Patent: Dec. 9, 2008

(54) DROPLET EJECTION APPARATUS, DROPLET EJECTION CONTROL APPARATUS AND DROPLET EJECTION METHOD

(75) Inventor: Toshinobu Hamazaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 121 days.

(21) Appl. No.: 11/703,455

(22) Filed: Feb. 7, 2007

(65) Prior Publication Data

US 2008/0043049 A1 Feb. 21, 2008

(30) Foreign Application Priority Data

Aug. 16, 2006 (JP) ..... 2006-221838

(51) Int. Cl.
*B41J 29/38* (2006.01)

(52) U.S. Cl. ..... 347/14; 347/10; 347/57

(58) Field of Classification Search ..... 347/10, 347/14, 19

See application file for complete search history.

(56) References Cited

U.S. PATENT DOCUMENTS 5,757,392 A * 5/1998 Zhang ..... 347/14

6,629,741 B1 * 10/2003 Okuda et al. ..... 347/11

FOREIGN PATENT DOCUMENTS

| | | |
|---|---|---|
| JP | 04-282255 | 10/1992 |
| JP | 2002-321360 | 11/2002 |
| JP | 2003-48314 | 2/2003 |
| JP | 2004-160863 | 6/2004 |

* cited by examiner

*Primary Examiner*—Thinh H Nguyen
(74) *Attorney, Agent, or Firm*—Fildes & Outland, P.C.

(57) ABSTRACT

A droplet ejection apparatus includes an ejecting unit, a driving unit and a correcting unit. The ejecting unit has plural droplet ejection portions that include pressure chambers containing a liquid, ejecting portions ejecting droplets, and driving elements that cause the ejecting portions to eject droplets of a droplet volume in accordance with a driving signal. The driving unit generates a driving signal according to ejection data and applies the driving signal with a predetermined voltage application cycle period. Between different volume droplets, when a difference of the ejection time, from ejection until adhering to a medium, or from application of the driving signal until adhering to the medium, exceeds ½ the voltage application cycle period, the correcting unit corrects the ejection data according to the ejection time difference such that the voltage application timing of the driving signal is corrected by an integer multiple of the voltage application cycle period.

19 Claims, 19 Drawing Sheets

PAPER CONVEYING DIRECTION
NOZZLE ROW DIRECTION

FIG.8A
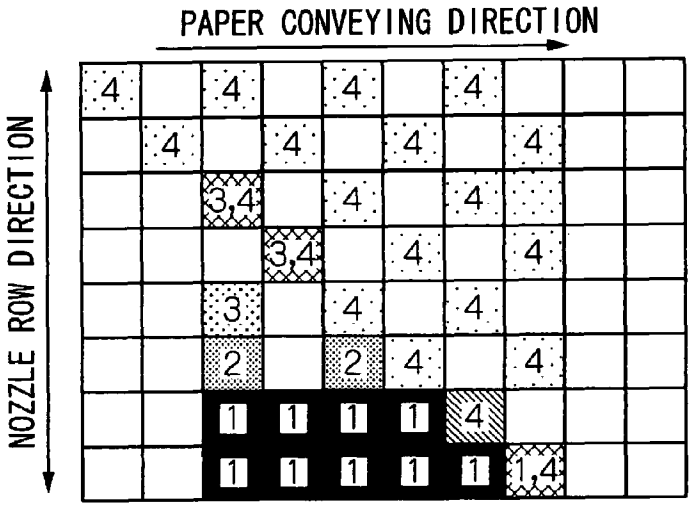
FIG.8B
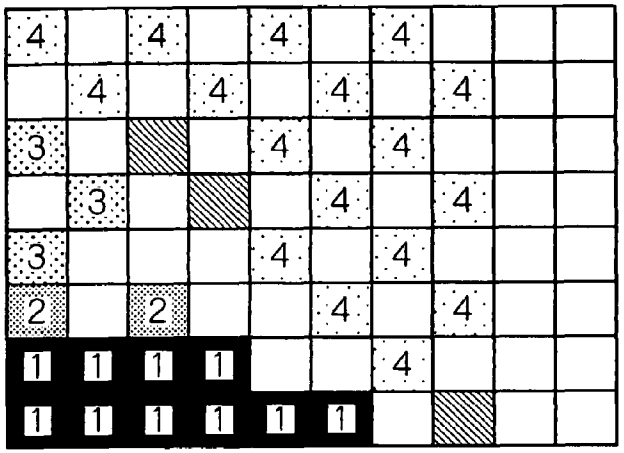
FIG.8C
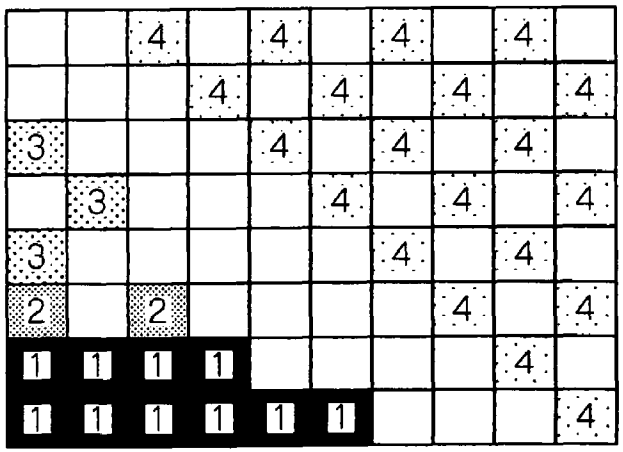
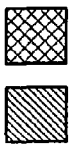

PAPER CONVEYING DIRECTION
NOZZLE ROW DIRECTION

V
HV2
HV1
GND
T1
T2
T3
t

FIG.12

| | WAVEFORM 1 (LARGE) | WAVEFORM 2 (MEDIUM) | WAVEFORM 3 (SMALL) | WAVEFORM 4 (MICRO) |
|---|---|---|---|---|
| GND(V) | 0.0 | 0.0 | 0.0 | 0.0 |
| HV1(V) | 18.0 | 18.0 | 18.0 | 18.0 |
| HV2(V) | 24.0 | 24.0 | 24.0 | 24.0 |
| $\tau$ ($\mu$sec) | 1.0 | 1.0 | 1.0 | 1.0 |
| T1($\mu$sec) | 6.5 | 6.5 | 6.5 | 6.5 |
| T2($\mu$sec) | 12.0 | --- | 3.0 | 1.5 |
| T3($\mu$sec) | --- | --- | 2.5 | 4.0 |
| DROPLET VOLUME (pl) | 12.0 | 8.0 | 4.7 | 2.0 |
| DROPLET SPEED (m/sec) | 13.5 | 11.0 | 10.0 | 6.0 |

FIG.15A

| | WAVEFORM 1 | WAVEFORM 2 | WAVEFORM 3 | WAVEFORM 4 |
|---|---|---|---|---|
| DROPLET SPEED Vd(m/sec) | 13.5 | 11.0 | 10.0 | 6.0 |
| DROPLET SPEED DIFFERENCE ΔVd(m/sec) | 2.5 | 0.0 | −1.0 | −5.0 |
| IMPACT TIME DIFFERENCE ΔT(μ sec) | −25.3 | 0.0 | 13.6 | 113.6 |
| IMPACT POSITION MISALIGNMENT AMOUNT ΔL(μm) | −9.6 | 0.0 | 5.2 | 43.3 |

FIG.15B

| | WAVEFORM 1 | WAVEFORM 2 | WAVEFORM 3 | WAVEFORM 4 |
|---|---|---|---|---|
| DROPLET SPEED Vd(m/sec) | 13.5 | 11.0 | 10.0 | 6.0 |
| DROPLET SPEED DIFFERENCE ΔVd(m/sec) | 2.5 | 0.0 | −1.0 | −5.0 |
| IMPACT TIME DIFFERENCE ΔT(μ sec) | −25.3 | 0.0 | 13.6 | 2.4 |
| IMPACT POSITION MISALIGNMENT AMOUNT ΔL(μm) | −9.6 | 0.0 | 5.2 | 0.9 |

CASE OF INDEPENDENT VARIATION

CASE OF CORRELATION

FIG.17

| | | |
|---|---|---|
| 1ST DRIVING WAVEFORM | LARGE DROPLETS | RANK1 |
| 2ND DRIVING WAVEFORM | LARGE DROPLETS | RANK2 |
| 3RD DRIVING WAVEFORM | LARGE DROPLETS | RANK3 |
| 4TH DRIVING WAVEFORM | MEDIUM DROPLETS | RANK1 |
| 5TH DRIVING WAVEFORM | MEDIUM DROPLETS | RANK2 |
| 6TH DRIVING WAVEFORM | MEDIUM DROPLETS | RANK3 |
| 7TH DRIVING WAVEFORM | MEDIUM DROPLETS | RANK4 |
| 8TH DRIVING WAVEFORM | SMALL DROPLETS | RANK1 |
| 9TH DRIVING WAVEFORM | SMALL DROPLETS | RANK2 |
| 10TH DRIVING WAVEFORM | SMALL DROPLETS | RANK3 |
| 11TH DRIVING WAVEFORM | SMALL DROPLETS | RANK4 |
| 12TH DRIVING WAVEFORM | MICRO DROPLETS | RANK1 |
| 13TH DRIVING WAVEFORM | MICRO DROPLETS | RANK2 |
| 14TH DRIVING WAVEFORM | MICRO DROPLETS | RANK3 |
| 15TH DRIVING WAVEFORM | MICRO DROPLETS | RANK4 |
| 16TH DRIVING WAVEFORM | PREPARATORY WAVEFORM | |

DROPLET EJECTION APPARATUS, DROPLET EJECTION CONTROL APPARATUS AND DROPLET EJECTION METHOD

CROSS-REFERENCE TO RELATED APPLICATIONS

This application is based on and claims priority under 35 USC 119 from Japanese Patent Application No. 2006-221838 filed Aug. 16, 2006.

BACKGROUND

1. Technical Field

The present invention relates to a droplet ejection apparatus, capable of ejecting droplets of plural types of different droplet volumes, and to a droplet ejection control apparatus and a method for droplet ejection of the same.

2. Related Art

Currently, ink jet printers are widely used that have a recording head arrayed with plural ejection apertures, and droplets of liquid ink are ejected by driving actuators that correspond with each ejection aperture with a predetermined voltage application cycle period, and printing on a printing medium. Among these, printers are known in which piezoelectric elements are used as actuators, and by application of driving signals of different driving waveforms to the piezoelectric elements, ink droplets of different droplet volume may be ejected according to the image data.

However, when the droplet volume of the ink droplets is changed the droplet speed (the speed required for the ejected droplets to adhere to the recording medium) also often changes. This difference in droplet speed due to the droplet volume gives rise to misalignment in the impact positions on the recording medium between the different droplet types, and this is a cause of deteriorating image quality (here, impact has the meaning of the adherence of ink or the like ejected from the recording head to paper or such like medium onto which the droplets are ejected).

Conventionally, analog driving waveforms are widely used wherein the shape of the waveform of the driving signal applied to a piezoelectric element may be arbitrary set in the time direction and the electrical voltage direction. In an analogue driving waveform, it is relatively easy to change the droplet volume without substantially changing the droplet speed. However, disadvantages are that the driving circuit for an analogue waveform is large, and the energy consumption is also large. Because of this the use of digital driving waveforms, generated by switching on and off digital switching elements connected to electrical voltages of two or three values, has become widespread. In this way driving circuits may be made compact and low cost, and reductions may be made in the energy consumption.

SUMMARY

In consideration of the above circumstances, the present invention provides a droplet ejection apparatus, droplet ejection control apparatus and a method for droplet ejection.

According to an aspect of the invention, there is provided a droplet ejection apparatus comprising: an ejecting unit provided with plural droplet ejection portions, each droplet ejection portion comprising: a pressure chamber containing a liquid; an ejecting portion communicating with the pressure chamber and ejecting droplets according to changes in pressure in the pressure chamber; and a driving element that changes the pressure in the pressure chamber according to a driving signal applied thereto and causes the ejecting portion to eject the droplets of a droplet volume in accordance with the applied driving signal; a driving unit generating the driving signal according to ejection data and applying the generated driving signal with a predetermined voltage application cycle period to the driving elements; and a correcting unit that corrects the ejection data such that a voltage application timing of the driving signal for the driving elements is corrected by an integer multiple of a voltage application cycle period according to a time difference of ejection times when, between a plurality of droplets of different droplet volumes which are ejected to a medium onto which the droplets are ejected, a difference of the ejection times, from ejection of the droplets from the ejecting portion until adhering of the droplets to the medium, or from application of the driving signal to the driving elements and the ejecting portion ejecting the droplets until adhering of the droplets to the medium, exceeds ½ the voltage application cycle period.

BRIEF DESCRIPTION OF THE DRAWINGS

Exemplary embodiments of the present invention will be described in detail based on the following figures, wherein:

FIG. 8A is a diagram showing ejection data after combination of the data from FIG. 7C after being corrected with the non-corrected data, FIG. 8B is a diagram showing an image printed when voltage application timing (ejection data) has been corrected, and FIG. 8C is a diagram showing an image printed when voltage application timing (ejection data) has not been corrected;

FIG. 12 shows detailed values of the waveform of each of the driving signals shown in FIGS. 11A to 11D, and shows the droplet volumes and the speeds of the ink droplets ejected by each of the driving signals;

FIG. 15A is a table showing speeds Vd of ink droplets by waveforms 1 to 4, differences in speed ΔVd of ink droplets by waveforms 1 to 4 relative to those of waveform 2 as the reference, differences in impact time ΔT of ink droplets by waveforms 1 to 4 relative to those of waveform 2 as the reference, differences in impact location ΔL of ink droplets by waveforms 1 to 4 relative to those of waveform 2 as the reference, FIG. 15B is a table showing difference in impact time ΔT and difference in impact location ΔL after voltage application timing correction of micro ink droplets by waveform 4;

FIG. 17 is a table showing plural driving waveforms that may be applied by a drive unit for each type of droplet;

DETAILED DESCRIPTION

Details of exemplary embodiments of the invention will now be explained with reference to the drawings.

First Exemplary Embodiment

Figure 1:
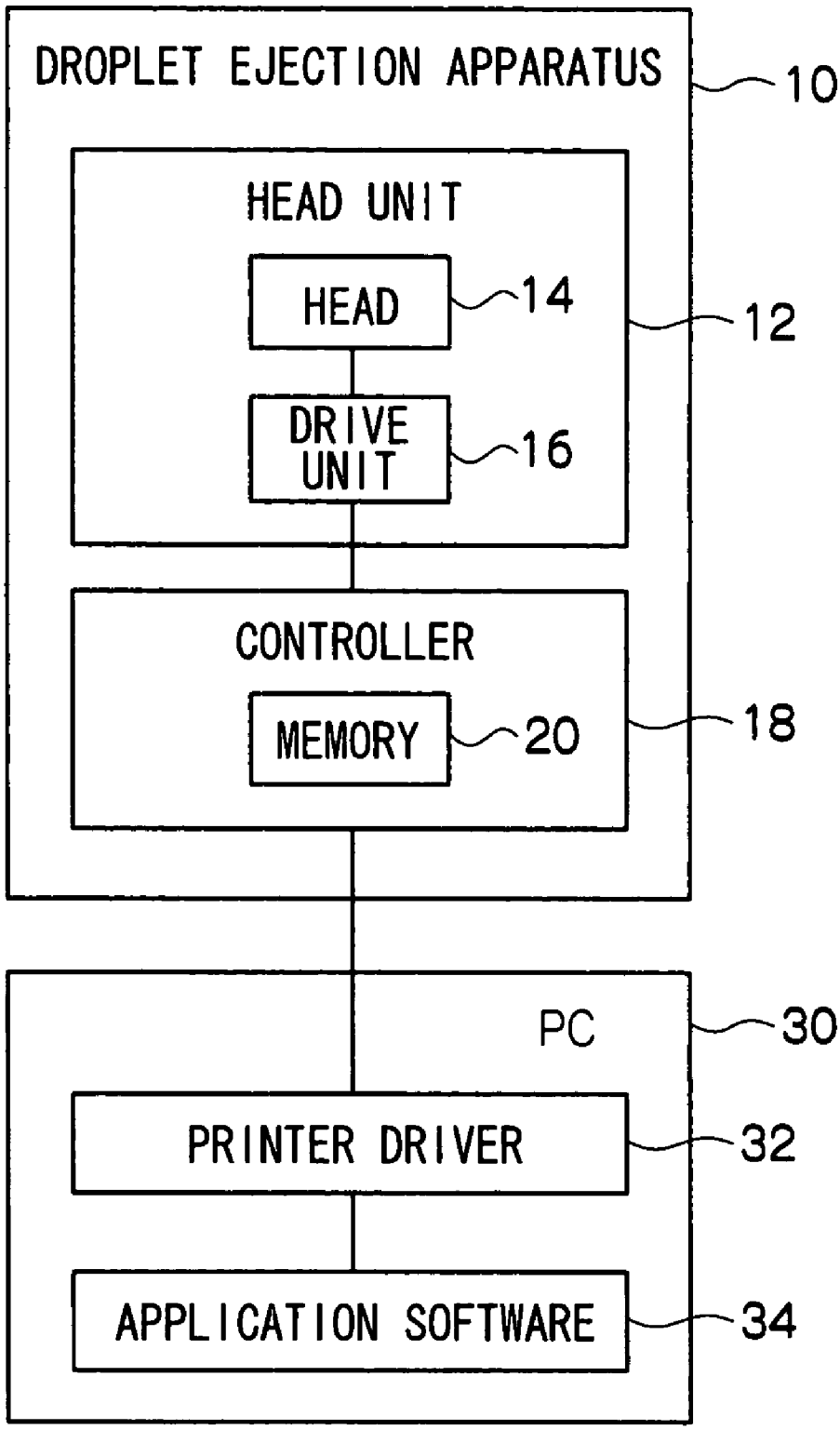
FIG. 1 is a block diagram showing a configuration of a droplet ejection apparatus according to exemplary embodiments 1 to 4 and of a personal computer (PC) that sends image data to the droplet ejection apparatus.

FIG. 1 is a block diagram showing a configuration of a droplet ejection apparatus 10 according to an exemplary embodiment 1 and of a personal computer (PC) that sends image data to the droplet ejection apparatus.

This droplet ejection apparatus 10 is an apparatus for ejecting droplets (in this exemplary embodiment ink droplets) onto a droplet receiving medium (in this exemplary embodiment paper). The droplet ejection apparatus 10 has a head unit 12 with a head 14 and a drive unit 16, and a controller 18. Here, in FIG. 1, the conveying system for conveying the paper has been omitted from the diagram.

The controller 18 is structured by a micro computer, and connected to the drive unit 16 structuring the head unit 12. The controller 18 generates a clock signal, a waveform signal on which a driving signal is based for ejection of ink droplets from head 14, a latch signal, a selection signal as ejection data and controller 18 outputs these signals to the drive unit 16.

Further, the controller 18 is provided with a power supply unit for driving the droplet ejection apparatus 10, such that the power supply unit supplies electrical power to head unit 12 and drive unit 16.

In the controller 18 is provided a memory 20. The memory 20 stores: waveform data for the generation of waveform signals; an alignment correction table for use in adjusting the impact location misalignments of ink droplets on the paper (in the present exemplary embodiment "impact" is used for ink droplets ejected from the head 14 adhering to the paper); a program for generating ejection data, on the basis of image data input from a PC 30, to cause ink droplets to be ejected from the head 14; and the like. The controller 18 uses the data stored in memory 20, and executes the program.

Figure 2:
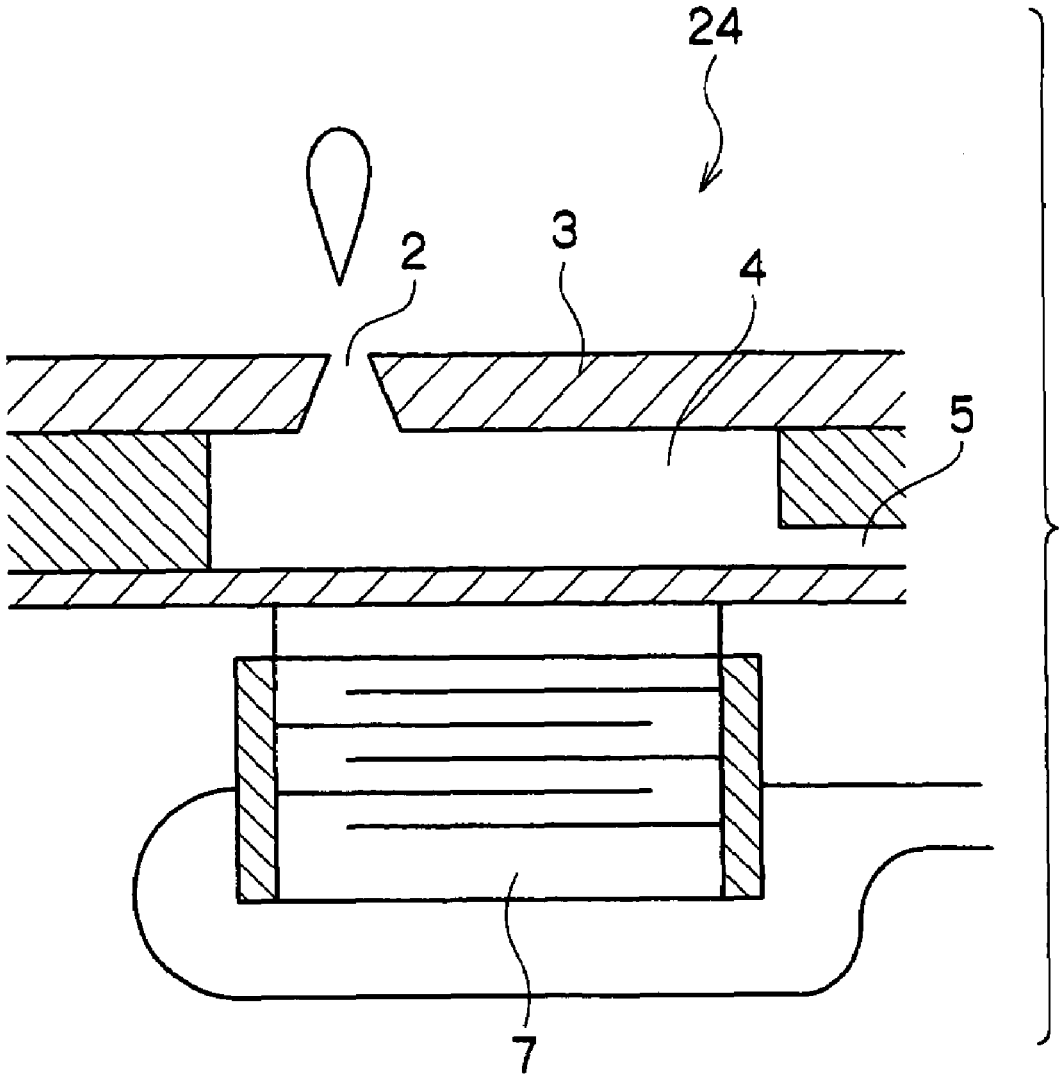
FIG. 2 is a cross-sectional outline diagram for explaining the structure of a droplet ejector.

The head unit 12 is equipped with the head 14 and the drive unit 16. The head 14 is structured by an array of plural droplet ejectors 24 for ejecting ink droplets. FIG. 2 is a cross-sectional outline diagram for explaining the structure of the droplet ejector 24. The droplet ejector 24 is structured by: a nozzle plate 3 formed with plural nozzles 2; pressure chambers 4 that correspond to each of the nozzles 2 and that are filled with ink for ejection from nozzles 2; an ink supply channel 5, for supplying ink from an ink tank (not illustrated) to the pressure chambers 4; and actuators (in this example piezoelectric elements) 7 that correspond to each of the pressure chambers 4. The driving signal is applied to the piezoelectric element 7, and, by driving, the pressure chamber 4 expands or contracts, and an ink droplet is ejected from nozzle 2 by the change in volume of the pressure chamber 4 of a specific amount due to the expansion and contraction (pressure changes).

It is not illustrated, but the head 14 of the present exemplary embodiment is a head that is long in the width direction of the paper, with a multiple array (two dimensional array) of nozzles in nozzle groups, each nozzle group being plural nozzles 2 arranged in the width direction of the paper, and the nozzle groups being disposed along the paper conveying direction such that the alignment therebetween changes slightly and progressively in the paper width direction.

Images are recorded with high resolution using the plural nozzles 2 in such a two dimensional array. In the droplet ejection apparatus 10 of the present exemplary embodiment, the heads 14 do not scan, and images are formed by ink being ejected onto the paper while the paper alone is conveyed at a uniform speed. Note that the paper is conveyed and the head 14 is scanned relative to the paper. However, as long as relative scanning is carried out, the head 14 side may be moved.

Each of the piezoelectric elements 7 of the droplet ejectors 24 are driven by the application of a driving signal from the drive unit 16.

Figure 3:
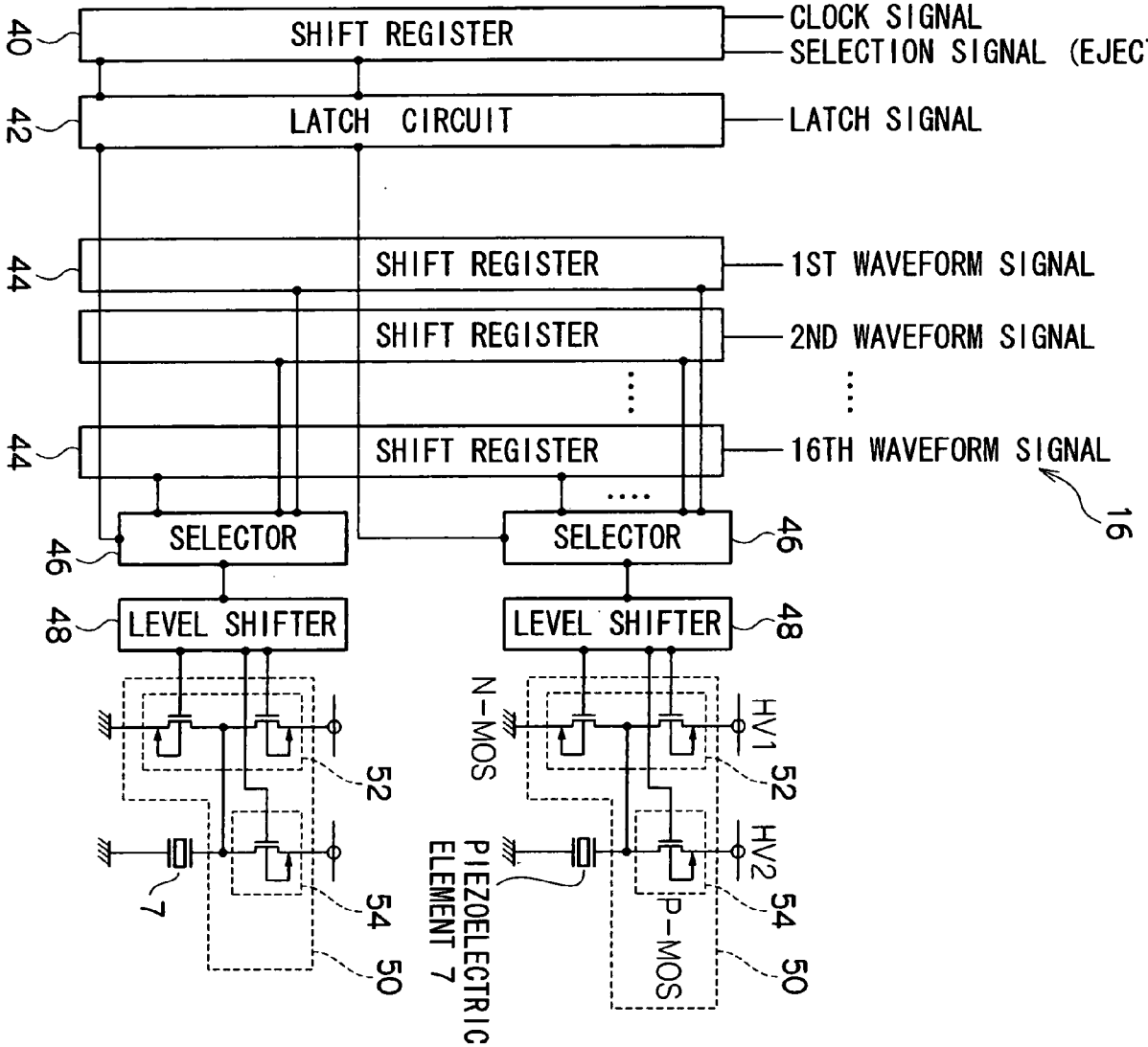
FIG. 3 is a block diagram showing an example outline structure of a drive unit.

FIG. 3 is block diagram showing an example outline structure of the drive unit 16. The drive unit 16 is structured to include: a shift register 40; a latch circuit 42; shift registers 44 provided corresponding to the possible driving signals that may be generated (in the present exemplary embodiment sixteen thereof); selectors 46 provided for each nozzle 2; level shifter 48; and a driving waveform generating circuit 50.

The clock signal and selection signal output from the controller 18 are input to the shift register 40, and the latch signal is input to the latch circuit 42.

The selection signal is a signal which the controller 18 generates based on the image data for selecting which of one of the sixteen types of driving signals. The selection signal is serial data of plural bits. This selection signal is input sequentially to the shift register 40 the number of times that there are droplet ejectors 24.

The shift register 40 converts to parallel data the selection signal of the input serial data and outputs to the latch circuit 42. The latch circuit 42, input with the parallel data from the shift register 40, latches (self-retains) according to the input latch signal.

Each of the shift registers 44 is input from the controller 18 with waveform signals that are to be the basis of the respective driving signal 1 to driving signal 16.

The selector 46 selects one waveform signal from plural waveform signals corresponding to the selection signal input from the shift register 40, via the latch circuit 42. The waveform signal selected by the selection signal is shifted in timing according to the arrangement of the nozzles 2 by the shift register 44, and output to the selector 46. Then the waveform signal is converted by the level shifter 48 and output to the driving waveform generating circuit 50.

The driving waveform generating circuit 50, is supplied with electrical power at an HV1 or HV2 voltage level by the non illustrated power supply unit.

The driving waveform generating circuit 50 is structured by a first signal generating circuit 52 and by a second signal generating circuit 54, and the first signal generating circuit 52 is structured as an inverter circuit with a PMOSFET and a NMOSFET connected in serial, and the second signal generating circuit 54 is structured with a PMOSFET.

Electrical power of voltage level HV1 is supplied for the source of the PMOSFET of the first signal generating circuit 52, and the source of the NMOSFET is grounded at ground level. Each of the PMOSFET and NMOSFET gates are connected to the output terminal of the level shifter 48.

Electrical power of voltage level HV2 is supplied for the source of the PMOSFET of the second signal generating circuit 54, and the drain thereof is connected to the connection point (drain) of the PMOSFET and NMOSFET of the first signal generating circuit 52. Further, the PMOSFET gate of the second signal generating circuit 54 is connected to the output terminal of the level shifter 48.

In this driving waveform generating circuit 50, on the basis of the input waveform signal from the level shifter 48, driving signals may be generated having the three voltage levels of ground level, voltage level HV1 and voltage level HV2 and applied to the piezoelectric element 7. Below, the waveforms of each of the driving signals are referred to as driving waveforms.

Also, in the present exemplary embodiment, an example will be given and explained in which the droplet ejection apparatus 10 is set so that 4 types of ink droplets of different droplet volumes may be ejected. In the present exemplary embodiment, the names given to the droplet volumes of the 4 types of ink droplets are, in size order, large droplets, medium droplets, small droplets, micro droplets.

Figure 4A:
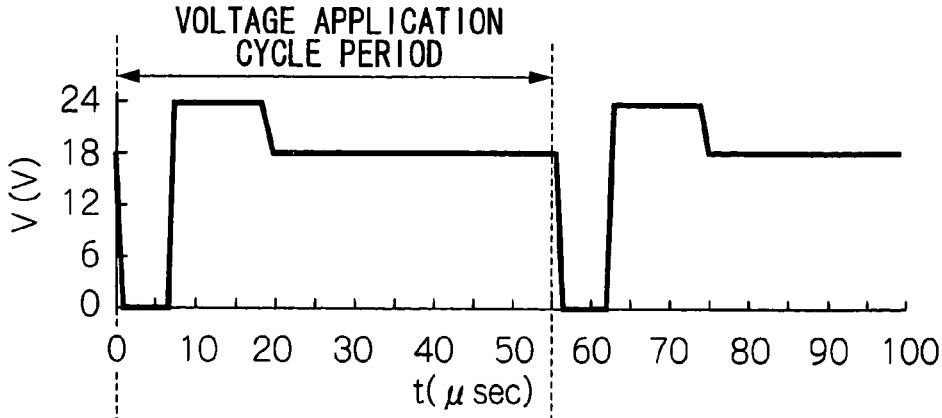
FIGS. 4A to 4D are charts showing an example of the driving waveforms of the driving signals applied to piezo elements for ejecting 4 types of ink droplets.
Figure 4B:
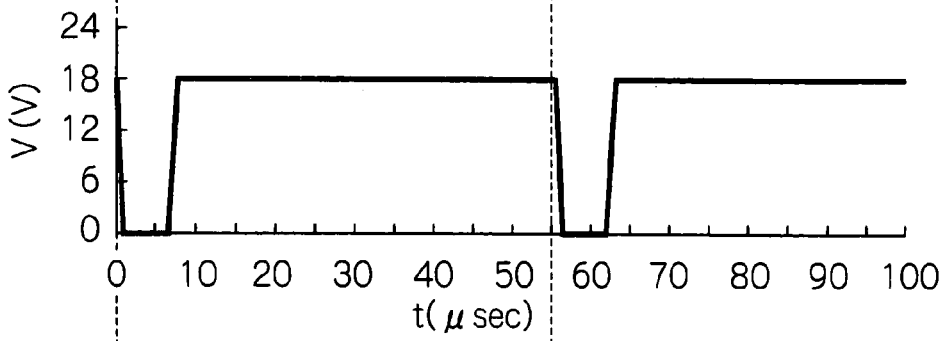
Figure 4C:
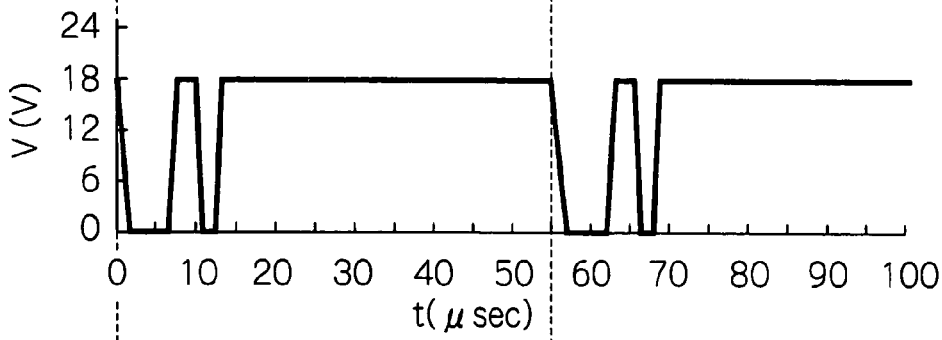
Figure 4D:
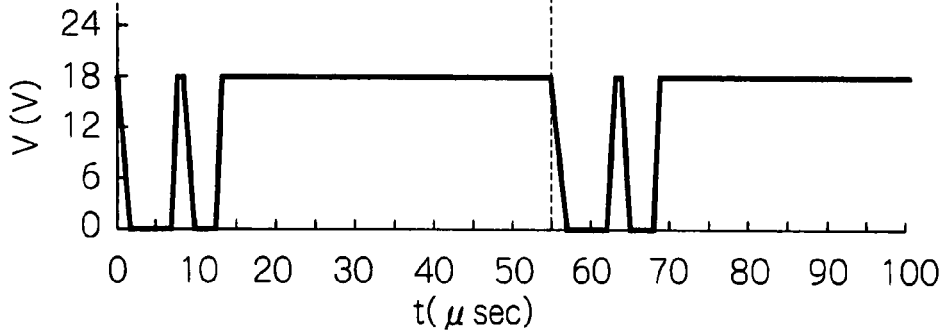

FIGS. 4A to 4D are charts showing an example of the driving waveforms of the driving signals applied to piezo elements for ejecting 4 types of ink droplets;

FIG. 4A is a waveform for large droplets, FIG. 4B is a waveform for use with medium droplets, FIG. 4C is a waveform for small droplets, and FIG. 4D is a waveform for micro droplets. Here, in FIGS. 4A to 4D the horizontal axis represents time, and the cycle period of the driving signal applied to piezoelectric elements 7 (voltage application cycle period) is 55.6 μsec. In this exemplary embodiment, the rising timing of the first pulse for ejecting the ink droplet applied in the voltage application cycle period (first pulse) is the same in each of the driving signals, and the period of time from applying the voltage of each of the driving signals to the time when the droplet is ejected is also the same.

Here, whilst it is not shown in the diagram, there is also a driving signal that changes the pressure in the pressure chambers 4 of the droplet ejectors 24 (preparation driving signal) wherein, at predetermined timings when not printing, the piezoelectric elements 7 are driven, but driven by an amount such that ink droplets are not ejected from the droplet ejectors 24. By voltage application of the preparation driving signal increase in the viscosity of the ink may be prevented.

The droplet ejection apparatus 10 is configured with the functionality that enables the generation of the above sixteen types of driving signal waveform, however, in the present exemplary embodiment, explanation will only be given of four types of driving signals for ejecting the above four types of ink droplets, and of a fifth type of driving signal that is a preparation driving signals.

The PC 30 for outputting the image data to the droplet ejection apparatus 10, on which the ejection data is based, is structured to include a CPU, RAM, ROM, hard disk, and the like. Application software 34 and printer driver software 32 is also installed therein.

The CPU of the PC 30 executes the printer driver software 32, receives the print command generated by the application software 34, and sends the image data for use in printing to the controller 18 of the droplet ejection apparatus 10. The controller 18, on the basis of the received image data, generates ejection data of the selection signal for ejecting the ink droplets from the head unit 12, and outputs the ejection data to the drive unit 16.

Thereby, the waveforms of the driving signals corresponding to the selection signals are applied to the piezoelectric elements 7 of each of the droplet ejectors 24 in accordance with rising timings of voltage application cycle period trigger signals that are output at an predetermined interval period (voltage application cycle period). The voltage application cycle period trigger signal is generated by the controller 18 and output.

Now, with reference to FIG. 5, the operation of the droplet ejection apparatus 10 according to the present exemplary embodiment will be explained.

Figure 5:
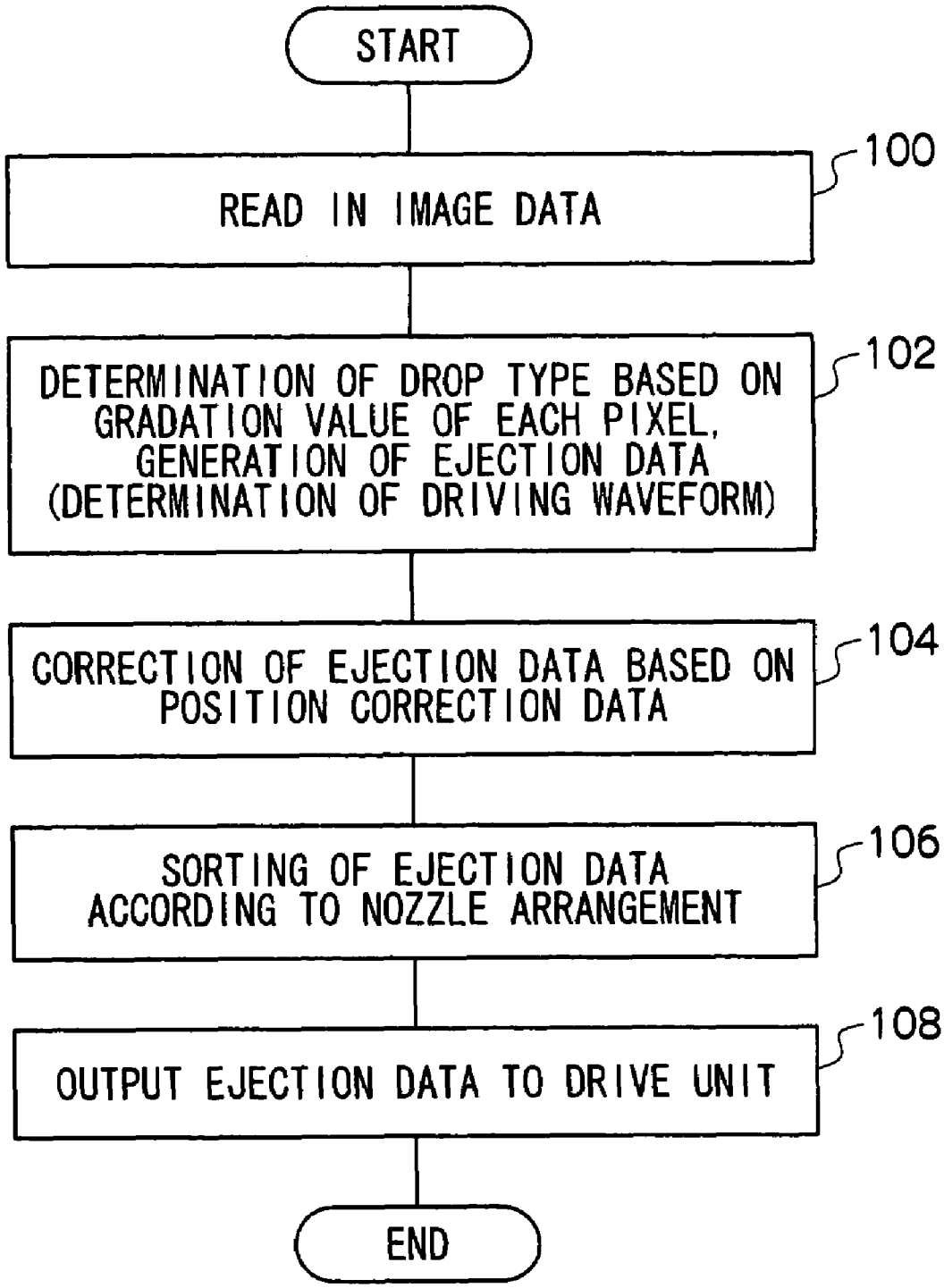
FIG. 5 is a flow chart showing an example of the flow when executing an ejection data generation/output processing routine in the droplet ejection apparatus controller during printing operation.

FIG. 5 is a flow chart that shows a flow of an ejection data generation/output processing routine execution in the controller 18 of the droplet ejection apparatus 10 during the printing operation.

In Step 100, the image data received from the PC 30 is read in.

In Step 102, the droplet type for forming each of the pixels is determined from the gradation values of each of the pixels constructing the image data. That is, it is determined for each of the pixels which droplet volume of a large droplet, a medium droplet, a small droplet, or a micro droplet is to be used for ejection. Then, the selection signal, for selecting the driving signal (waveform signal) for ejecting the ink droplet of the determined droplet volume, is generated as the ejection data.

In Step 104, the above generated ejection data is corrected based on position alignment correction data. Position alignment correction data is data that indicates the amount of correction to be made in the voltage application timing of the driving signal for each of the droplet types, and is derived from experimentation and the like and stored in advance in the memory 20.

The impact time from the ejection of the ink droplet to impact thereof on the paper, is different for each of the droplet volumes (droplet types). Usually, since the smaller the droplet volume the slower the droplet speed (the speed of the ink droplet from ejection till adhering to the paper), the impact time is longer for small droplets relative to that of large droplets, so relative to paper that is being conveyed at a uniform rate there is a tendency for the position of impact of small droplets to be downstream in the paper conveying direction. Because of this impact position misalignment occurs among the droplet types.

Figure 6:
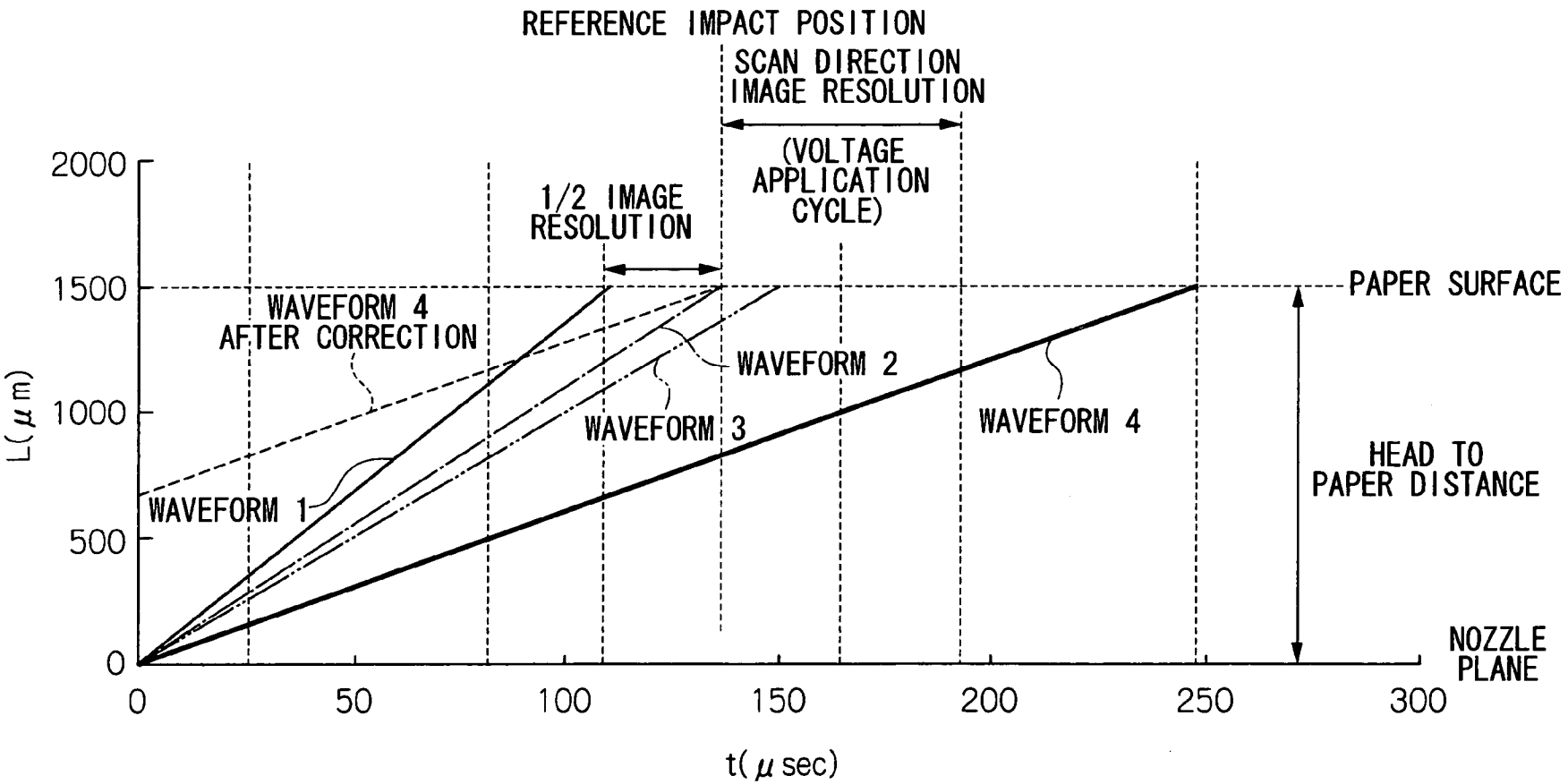
FIG. 6 is a graph showing an example of the times taken for 4 types of ink droplet from ejection from a head till adhering to paper.

FIG. 6 is a graph showing an example of the times taken for four types of ink droplet from ejection from the head 14 till adhering to paper. The line shown by waveform 1 is the graph of large droplets, the line shown by waveform 2 is the graph of medium droplets, the line shown by waveform 3 is the graph of small droplets, and the line shown by waveform 4 is the graph of micro droplets. As may be seen for FIG. 6, the time from ejection from each of the heads 14 till adhering to the paper is different for each of the droplet types.

As explained above, in the droplet ejection apparatus 10 of the present exemplary embodiment, heads 14 are used in which plural nozzles 2 are arranged in a two dimensional array, the heads 14 are not scanned, and images are formed by ejecting ink onto paper while the paper alone is conveyed at a uniform speed. It follows that, the level of resolution in the paper conveying direction depends on the voltage application cycle period for the ink droplets and not on the arrangement of the nozzles 2. As seen in the same FIG. 6, the larger the droplet volume, the longer the time till adhering to the paper. However, the time difference in the impact times of large droplets and small droplets relative to medium droplets as a reference is small, less than ½ the voltage application cycle period, however, for micro droplets the difference in impact time thereto is about twice the voltage application cycle period. And as the difference in impact time gets bigger, the impact positions of the ink droplets on the paper become misaligned in the paper conveying direction.

It follows that, in Step 104, when a large misalignment in the impact position occurs with an excess of ½ the voltage application cycle period, correction is made of the voltage application timing of the driving signal based on the position correction data recoded in the memory 20 by an integer multiple of the voltage application cycle period. The position correction data is data that indicates the amount of correction to be made in the voltage application timing for each of the droplet types.

Specifically, when the differences in the impact times between the four droplet types is as shown in FIG. 6, then the ejection data is corrected so that the driving signal for ejecting the micro droplets causes ejection that is two voltage application cycle periods ahead, correcting so that the differences in the times of the impact times are less than ½ the voltage application cycle period. In the present exemplary embodiment, as the position alignment correction data, correction amounts for each of the types of droplets is stored as below. Here, the optimal correction amounts are derived in advance by experimentation and the like.

correction amount to the driving signal for ejection of large droplets, medium droplets and small droplets of ink=0 (no correction)

correction amount to the driving signal for ejection of micro droplets of ink=−2 voltage application cycle periods (2 cycles ahead)

The voltage application timing correction is carried out by correcting the ejection data. Specifically, the correction is made to move ahead by two pixels (2 cycles of the voltage application periods) in the paper conveying direction the ejection data that corresponds to micro droplets. A specific example of correction will now be given.

In Step 106, sorting of the ejection data according to the nozzle 2 arrangement is carried out. The sorting processing that is carried out here is not sorting processing for carrying out the correction of the impact alignment of the droplet volume of the ink droplets. As stated above, since the nozzles 2 are arranged in the heads 14 in two dimensional arrays, adjustment is required of the voltage application timing of the ejection data corresponding to the arrangement of the nozzles 2. It follows that, here, sorting is of the ejection data according to the arrangement of the nozzles.

In Step 108, the ejection data corrected and sorted as above is output to the drive unit 16 and printed. In the drive unit 16 the input ejection data is used as the selection signal, and as described above, appropriate waveform driving signals are applied to each of the piezoelectric elements 7, ink droplets are ejected and printing is carried out.

Here, explanation will be given of a specific example of correction of the ejection data for correcting the impact position misalignment between plural types of droplet.

Figures 7A, 7B, 7C:
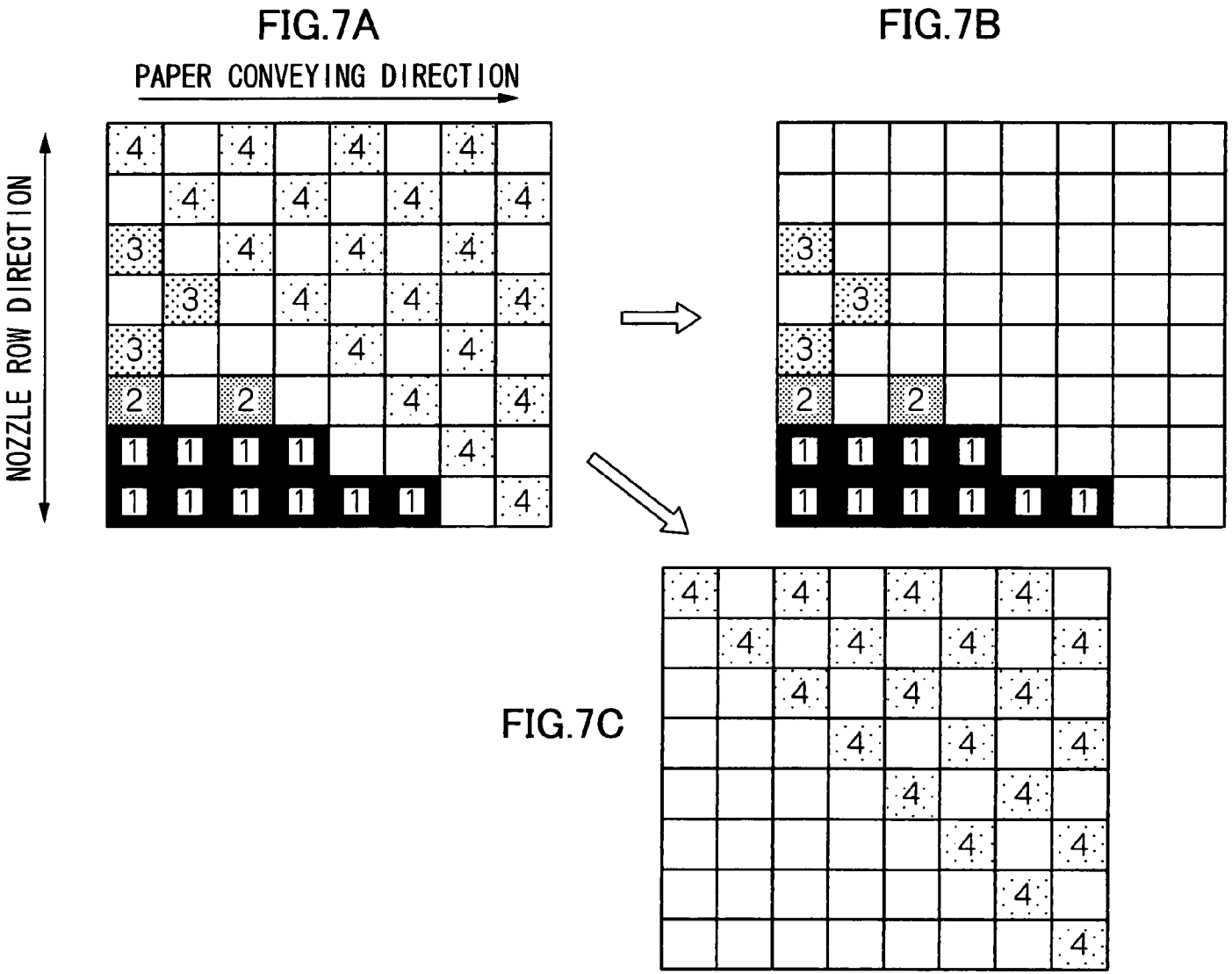
FIG. 7A is a diagram showing an example of ejection data before correction.
FIG. 7B is a diagram showing data to which no voltage application timing correction is applied separated out from the ejection data before correction of FIG. 7A.
FIG. 7C is a diagram showing data to which voltage application timing correction is applied separated out from the ejection data before correction of FIG. 7A.

FIG. 7A is a diagram showing an example of ejection data before correction. In Step 102 the driving waveform for each of the pixels is selected corresponding to the gradation value, and based on the image data that is to be printed, ejection data such as that shown in FIG. 7A is generated. In this FIG. 7A, the ejection data shown by the numeral 1 is ejection data for selecting the waveform signal on which the driving signal for ejecting large droplets will be based, the ejection data shown by the numeral 2 is ejection data for selecting the waveform signal on which the driving signal for ejecting medium droplets will be based, the ejection data shown by the numeral 3 is ejection data for selecting the waveform signal on which the driving signal for ejecting small droplets will be based, and the ejection data shown by the numeral 4 is ejection data for selecting the waveform signal on which the driving signal for ejecting micro droplets will be based.

This ejection data is split into ejection data for which the voltage application timing is not to be corrected (FIG. 7B) and ejection data for which the voltage application timing is to be corrected (FIG. 7C). Here, the ejection data for selecting the waveform signal that is to be the basis of the driving signal for ejecting the three types of droplet that are large droplets, medium droplets, and small droplets are treated as ejection data for which there is no correction, and ejection data for selecting the waveform signal that is to be the basis of the driving signal for ejecting micro droplets is treated as ejection data for which there is correction.

Then, relative to the no correction ejection data (FIG. 7B), the ejection data for correction (FIG. 7C) is advanced by two voltage application cycle periods in the time related row direction (in figure this is the paper conveying direction), and then the no correction ejection data and the corrected ejection data are combined. FIG. 8A is a figure showing the ejection data after combination. Thereby, the voltage application timing of the driving signal for micro droplets is made early by two cycles worth of the voltage application cycle period.

In FIG. 8A, the pixels indicated by cross-hatching, indicates pixels in which non correction data and corrected data coincide. It follows that, in these pixels, corrected ejection data is ignored, and non correction data is selected in preference. Here, an example in which non correction data is selected in preference is explained, however, corrected data may be selected in preference, the opposite.

FIG. 8B is a diagram showing an image that is printed that has had the above voltage application timing (ejection data) correction. At coincided pixels, as a result of the corrected ejection data being ignored, and non corrected ejection data being given precedence, pixels shown on the diagonal are missing. However, the correction is made of the pixel misalignment of other micro droplet ink droplets.

However, the missing of such pixels is a result of voltage application timing coincidence due to dots being formed from pixels in the vicinity, and even if pixels are missing in these portions this does not really stand out.

Here, if printing were to be made without the voltage application timing correction, then printing would be as per the FIG. 8C. Whilst there are no missing pixels in this image the position of all of the pixels formed by micro droplets are misaligned with relative to the impact positions of ink droplets of different droplet volumes.

One more specific example will now be explained.

Figures 9A, 9B, 9C:
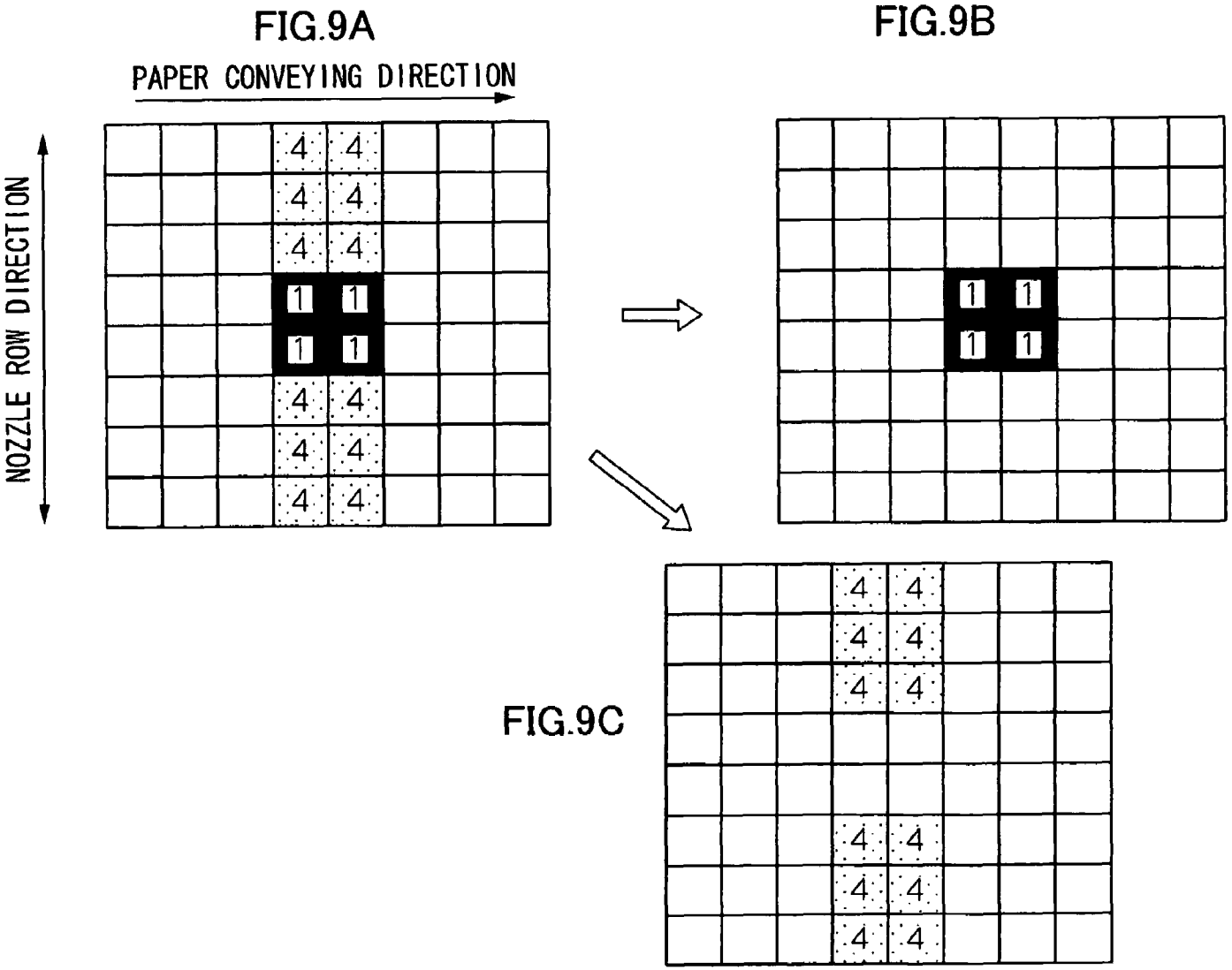
FIG. 9A is a diagram showing an example of ejection data before correction.
FIG. 9B is a diagram showing data to which no voltage application timing correction is applied separated out from the ejection data before correction of FIG. 9A.
FIG. 9C is a diagram showing data to which voltage application timing correction is applied separated out from the ejection data before correction of FIG. 9A.

FIG. 9A is an example of ejection data before correction.

This ejection data is split on the basis of alignment correction data, as before, into ejection data with no voltage application timing correction (FIG. 9B) and ejection data for voltage application timing correction (FIG. 9C).

Figure 10A:
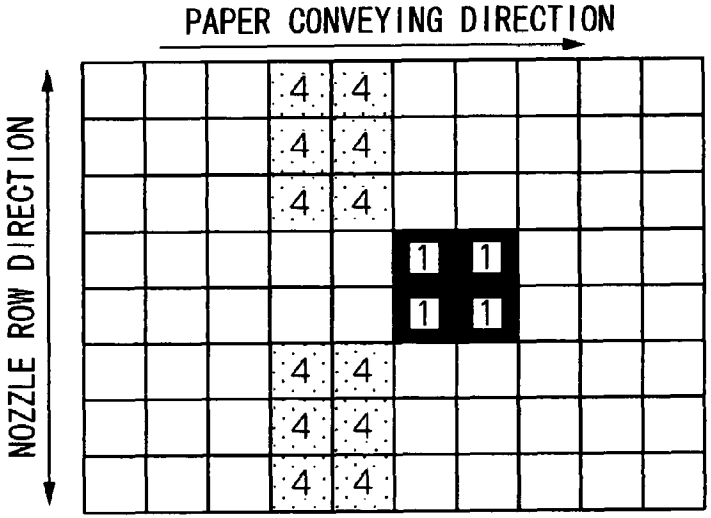
FIG. 10A is a diagram showing ejection data after combination of the data from FIG. 9C after being corrected with the non-corrected data.

Then, relative to the no correction ejection data (FIG. 9B), the ejection data for correction (FIG. 9C) is advanced by two voltage application cycle periods in the time related row direction (in figure this is the paper conveying direction), and then the no correction ejection data and the corrected ejection data are combined. FIG. 10A is a figure showing the ejection data after combination. Thereby, the voltage application timing of the driving signal for micro droplets is made early by two cycles worth of the voltage application cycle period.

Figure 10B:
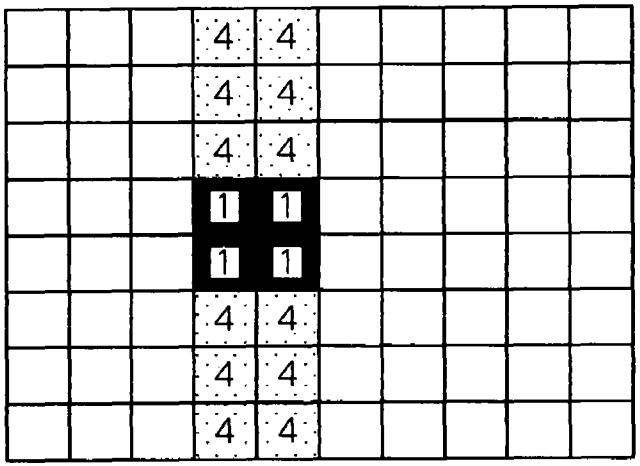
FIG. 10B is a diagram showing an image printed when voltage application timing (ejection data) has been corrected.
Figure 10C:
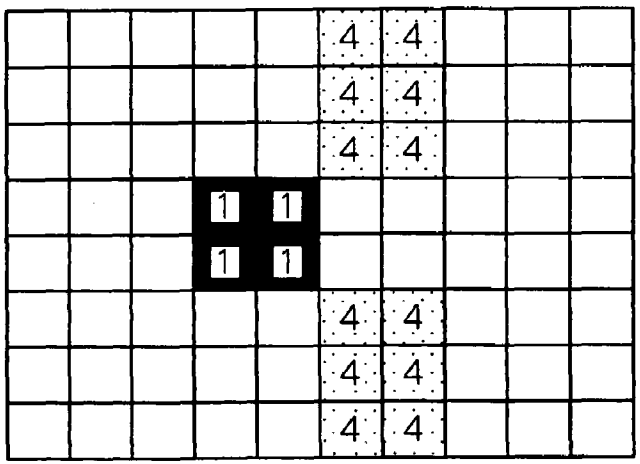
FIG. 10C is a diagram showing an image printed when voltage application timing (ejection data) has not been corrected.

FIG. 10B is a diagram showing an image that is printed that has had the above voltage application timing (ejection data) correction. FIG. 10C is a diagram showing how an image would look if it had not had the above voltage application timing (ejection data) correction.

In the non correction case as shown in FIG. 10C misalignment in the impact positions is generated, and the line is made not straight. In contrast, as may be seen from the corrected case in FIG. 10B, printing may be carried out with the line that was in the original data.

In FIG. 7A to FIG. 7C, and FIG. 8A to FIG. 8C an example where the original image is a half-tone image is shown, whereas in FIG. 9A to FIG. 9C, and FIG. 10A to FIG. 10C an example where the original image is a line (linear image) is shown. The effect of the above voltage application timing correction is great for line portions of writing characters and the likes, where misalignment in the impact positions between different droplet types particularly stands out.

Next, further detailed explanation will be given showing examples of specific values, regarding the ejection data correction in the above exemplary embodiment.

FIGS. 11A to 11D are waveform diagrams showing the structure of the pulses of each of the driving signals for generating the four types of ink droplet of FIGS. 4A to 4D.

Each of the driving signals are digital waveforms with three voltage level values, GND, HV1, and HV2, and are configured with a first pulse for expanding then contracting the pressure chamber 4 to cause an ink droplet to be ejected, and following the first pulse a second pulse, the application of this pulse not causing an ink droplet to be ejected (there may also be driving signals that do not include a second pulse).

In FIGS. 11A to 11D, T1 indicates the pulse width T1 of the first pulse, T3 indicates the pulse width of the second pulse, and T2 indicates the pulse interval. $\tau$ indicates the time period for the rising up/fall off of each of the pulses, determined by the static electrical capacity of the piezoelectric elements 7 and the on-resistance of the driving waveform generating circuit 50. Here, in the driving signal for causing the ejection of the ink droplets, the pressure chamber 4 is expanded by the dropping off of the first pulse, and the pressure chamber 4 is contracted by the rising up of the first pulse and an ink droplet is caused to be ejected.

Here, it is preferable to make the time for the rising up of the first pulse and the time for the falling off of the first pulse 1/50 to 1/4 that of the natural resonance period of the vibration of the ink meniscus. If the time for the rising up and the time for the falling of are too short then as a counter measure to electro-current constriction the driving signal circuit becomes of a large scale, and, further, due to a large amount of ringing the waveform is distorted. Further, if the times are too long, then droplet speed reduces, and it becomes impossible to make the droplet size smaller. It follows that the times are preferably in the above range.

Figures 11A, 11B, 11C, 11D:
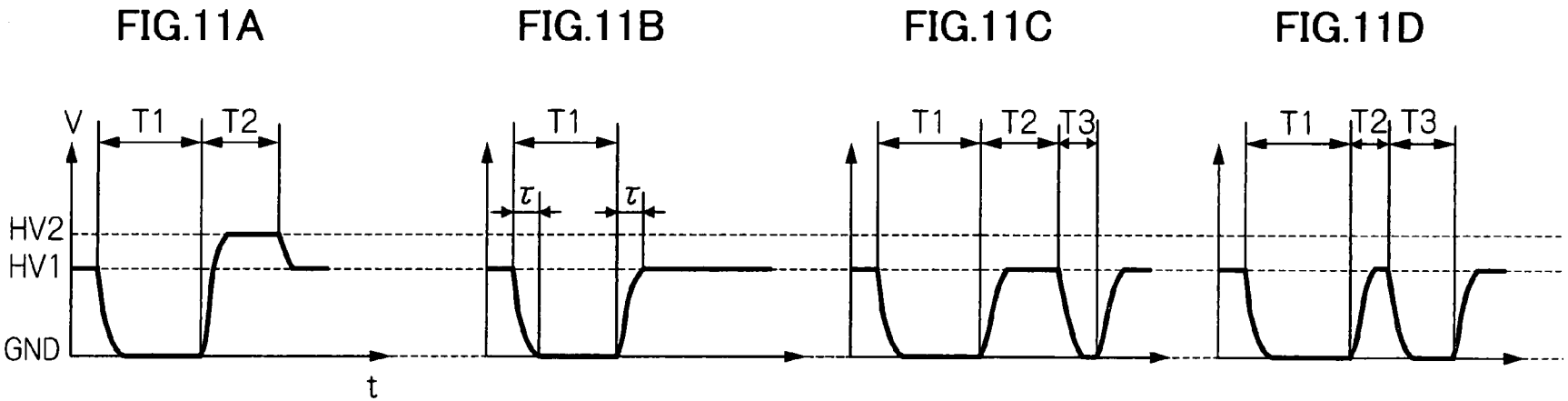
FIGS. 11A to 11D are waveform diagrams showing structures of each driving signal pulse for generating the 4 types of ink droplets of FIGS. 4A to 4D.

The waveform for causing large droplets to be ejected (waveform 1) is, as shown in FIG. 11A, configured of a first pulse. This driving signal does not include a second pulse, but a voltage level HV2 is applied for a pulse interval T2 continuing from the first pulse.

The waveform for causing medium droplets to be ejected (waveform 2) is, as shown in FIG. 11B, configured of a first pulse.

The waveform for causing small droplets to be ejected (waveform 3) is, as shown in FIG. 11C, configured of a first pulse, and, after a pulse interval of T2 from the application of the first pulse, a second pulse is applied.

The waveform for causing micro droplets to be ejected (waveform 4) is, as shown in FIG. 11D, configured of a first pulse, and, after a pulse interval of T2 from the application of the first pulse, a second pulse is applied, however, the pulse interval T2 is shorter than that of the driving signal for the small droplets.

FIG. 12 shows examples of numerical values for the waveforms of each of the driving signal shown in FIG. 11A to FIG. 11D, and the droplet volumes and the droplet speeds of the ink droplets that are caused to be ejected by each of the driving signals.

In the present exemplary embodiment, it is set such that the voltage level of HV1 is 18V, and the voltage level of HV2 is 24V. Also, $\tau$ is 1.0 μsec.

In the waveform 1, the pulse width T1 of the first pulse is 6.5 μsec, the pulse interval T2 is 12.0 μsec, the droplet volume is 12.0 pl, and the speed of the ink droplet from ejection till adhering to the paper is 13.5 m/sec.

In the waveform 2, the pulse width T1 of the first pulse is 6.5 μsec, the droplet volume is 8.0 pl, and the speed of the ink droplet from ejection till adhering to the paper is 11.0 m/sec.

In the waveform 3, the pulse width T1 of the first pulse is 6.5 μsec, the pulse interval T2 is 3.0 μsec, the pulse width T3 of the second pulse is 2.5 μsec, the droplet volume is 4.7 pl, and the speed of the ink droplet from ejection till adhering to the paper is 10.0 m/sec.

In the waveform 4, the pulse width T1 of the first pulse is 6.5 μsec, the pulse interval T2 is 1.5 μsec, the pulse width T3 of the second pulse is 4.0 μsec, the droplet volume is 2.0 pl, and the speed of the ink droplet from ejection till adhering to the paper is 6.0 m/sec.

Also, the natural resonance period of the ink meniscus is 13.0 μsec.

It is clear from the above, that the width T1 of the first pulse is approximately ½ of the above natural resonance period. By application of the first pulse with such a pulse width, good energy efficiency is obtained.

Also, the sum of the pulse interval T2 and the pulse width T3 of the second pulse is approximately ½ of the above natural resonance period. Thereby, there is rapid attenuation of the vibration of the meniscus after ink ejection, and stabilization may be made of ejection in sequential ejecting.

Figure 13A:
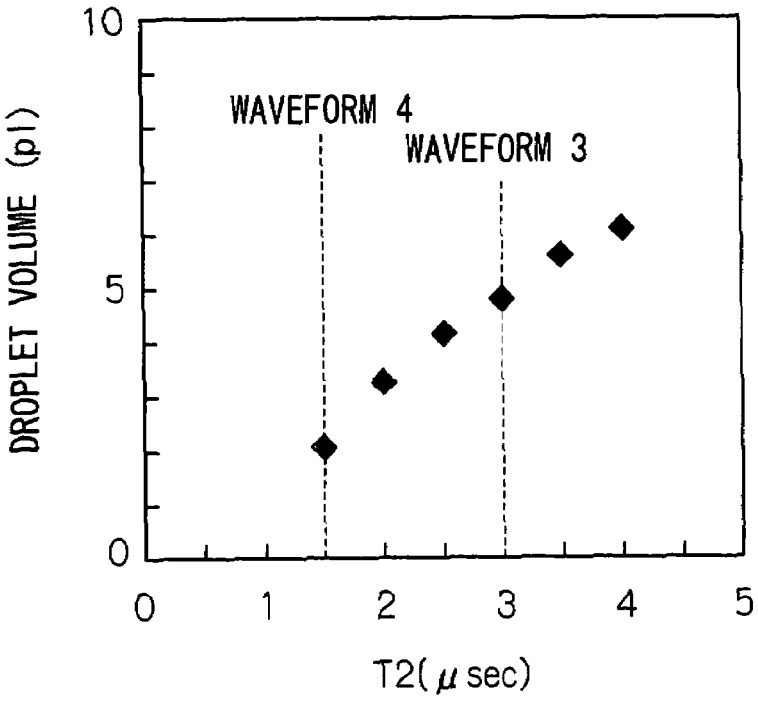
FIG. 13A is a graph showing the measured droplet volumes of the ink droplets with the parameter of the pulse interval T2 between a first pulse and a second pulse making up the driving signal.
Figure 13B:
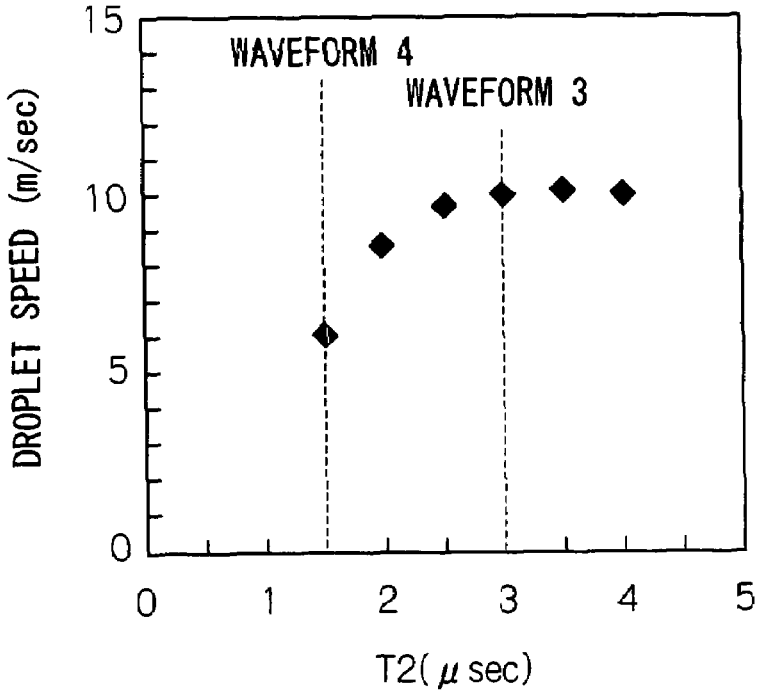
FIG. 13B shows the measured speeds of the ink droplets for the same parameters of pulse interval T2 between the first pulse and the second pulse making up the driving signal.

FIG. 13A shows a graph of the measured droplet volumes of the ink droplets for the parameter of the pulse interval T2 making up driving signals of the first pulse and the second pulse, FIG. 13B shows a graph of the measured droplet speeds of the ink droplets for the same parameters of pulse interval T2 making up driving signals configuring of the first pulse and the second pulse.

It may been seen that whereas there is a linear change in the droplet volume with changes in the pulse interval T2, the droplet speed diverges at a given value of pulse interval T2 and then changes rapidly. That is, when the value of pulse interval T2 is made shorter than a given value the droplet speed rapidly decreases. In the FIGS. 13A and 13B the pulse intervals T2 shown in the graphs by dotted lines correspond to the pulse intervals T2 of the waveform 3 and the waveform 4 of the FIG. 12. It may be seen that the droplet speed of ink droplets according to waveform 4 are significantly slower relative to those according to other waveforms.

As stated above, the rising up time and the falling off time of the first pulse, τ (in this case 1.0 μsec) is from 1/50 to ¼ of the natural resonance period of the ink meniscus, and further, it is clear from the graph of FIG. 13B that when the pulse interval T2 is within the range from one to two times τ there is a rapid decrease in the droplet speed. Accordingly, it is preferable to correct data for a droplet type whose pulse interval T2 is within this range. Here, in the present exemplary embodiment, there is correction of the driving signal for ejecting micro droplets (waveform 4).

Figure 14:
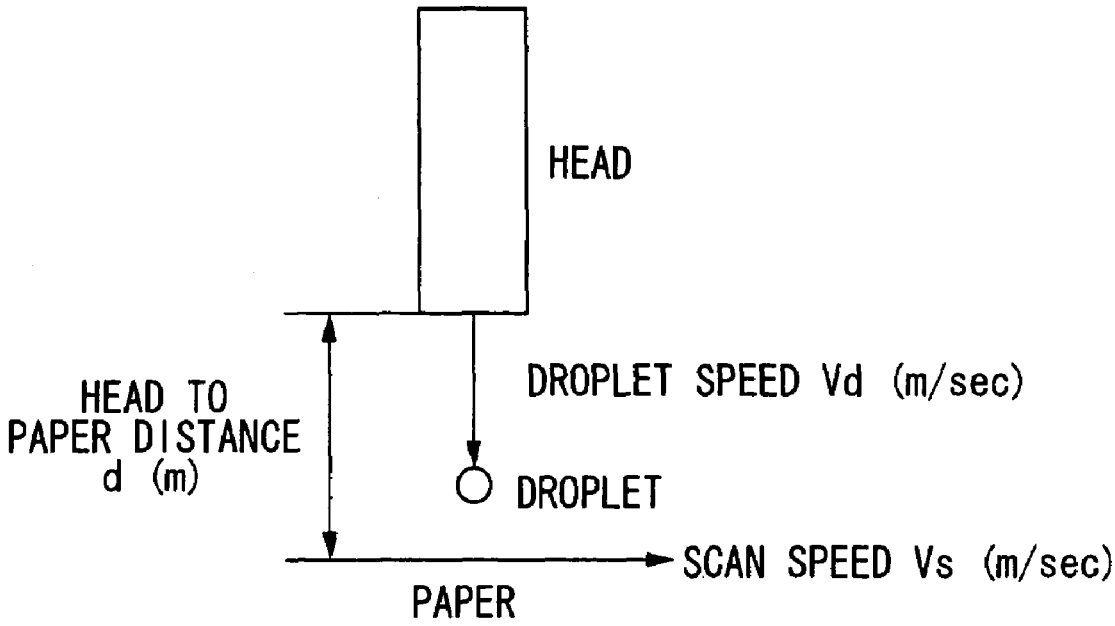
FIG. 14 is a diagram showing some of the parameters when droplets are ejected from a head onto paper.

Here, each of the parameters for the relative scanning of the head 14 to the paper in the present exemplary embodiment when printing is shown by the following figures (refer to the outline diagram of FIG. 14 for some of the parameters).

droplet speed±difference in droplet speed: $Vd \pm \Delta Vd$ (m/sec)

(if the droplet speed of the droplet type used as the reference is Vd, then ΔVd is the difference in droplet speed of the droplet type in question to that of the reference droplet type)

distance from the head to the paper: d(m)

resolution in the scanning direction: n(dpi)

ejection cycle frequency: f(kHz)

voltage application cycle period: $T0$(μsec)=1000/$f$ scanning speed: $Vs$(m/sec)=25.4×$f/n$ Here the scanning is the relative scanning of the head relative to the paper, and in the present exemplary embodiment the head is not moved, and by conveying the paper an image is recorded, and so the conveying direction of the paper is the scanning direction, and the conveying speed of the paper is the equivalent of the scanning speed.

Further, when a difference in impact time of a target droplet type in question from the impact time of the reference droplet type is designated ΔT, and an impact position misalignment amount of the target droplet type in question to the impact position of the reference droplet type ejected at the same time, difference in alignment amount, is designated ΔL, then ΔT or ΔL are derived from the following formulae.

the difference in impact time $\Delta T(\text{sec})=\{d/(Vd\pm\Delta Vd)\}-\{d/Vd\}$ the impact position misalignment amount: $\Delta L(m)=Vs\times\Delta T$ When, in the present exemplary embodiment, the medium droplets ejected by waveform 2 are the reference droplet type, the above described parameters are set to the values given below, then the difference in impact time ΔT and the impact position misalignment amount ΔL that are shown in the table of FIG. 15A are generated.

Distance from the head to the paper: $d(m)$=1.5E−3

Resolution in the scanning direction: $n$(dpi)=1200

Ejection cycle frequency: $f$(kHz)=18.0

Voltage application cycle period: $T0$(μsec)=1000/$f$=55.6

Scanning speed: $Vs$(m/sec)=25.4×$f/n$=0.381

It is clear from the table of FIG. 15A that, the impact time difference of the large droplets of the waveform 1 and the small droplets of the waveform 3, relative to the impact time of the medium droplets of the waveform 2, are ½ of the voltage application cycle period or less (27.8 μsec or less). However, the impact time difference of the micro droplets of the waveform 4, relative to the impact time of the medium droplets of the waveform 2, is different by two cycles worth (111.2 μsec) plus a remaining amount (2.4 μsec).

The difference in impact time and the impact position misalignment amount are shown on the graph of the previously described FIG. 6. Here, as explained above, the ejection data for the micro droplets of waveform 4 are corrected so as to eject ahead by two units of the voltage application cycle period. FIG. 15B is a table showing the difference in impact time ΔT and the impact position misalignment amount ΔL of waveform 4 for the micro droplets after carrying out the correction of the voltage applying timing. By such a correction, the impact positions of the micro droplets may be corrected as shown by the dotted line in FIG. 6, and the impact position misalignment amount may be made ½ of the voltage application cycle period or less (in this case the remaining difference is 2.4 μsec)

Here, since the remainder is ½ of the voltage application cycle period or less, correction has been as above, however, if the remainder is more than ½ of the voltage application cycle period then if the ejection data is corrected by a further one voltage application cycle period for the ejection timing then the difference in impact time may be suppressed to ½ of the voltage application cycle period or less.

Specifically, the following formula shows the difference in impact time between a type of droplet that is to be corrected and the reference droplet type (impact time difference).

Difference in impact time $\Delta T$ =

Impact time of the reference droplet type −

Impact time of the droplet type to be corrected =

Voltage application cycle period $T0\times N\pm$ remainder $\alpha$

Here, N is an integer, and $\alpha$ is a positive number.

Here, N is selected so that the remainder $\alpha$ becomes a numerical value that is ½ of the voltage application cycle period or less. The result is that, if N is negative then correction is made of the ejection data of the droplet type to be corrected so that the ink droplets are ejected early by N cycles worth of the voltage application cycle period, and if N is positive then correction is made of the ejection data of the droplet type to be corrected so that the ink droplets are ejected late by N cycles worth of the voltage application cycle period.

Thereby, differences in impact time of different droplet volumes may be suppressed to within less than ½ of the voltage application cycle period.

In the above, explanation was given with examples of actual numerical values, however, the present invention is not limited to these numerical values. The voltage application cycle period and driving signals as well are not limited to the above voltage application cycle period and driving signals. Further, the types of droplet are not limited to four droplet types, and may be any number of two or more types.

Also, in the present exemplary embodiment, explanation was given of an example in which the correction is made of the ejection data for the micro droplets such that the voltage application timing of the driving signal for the micro droplets is advanced by two voltage application cycle periods worth. However, the ejection data of the droplet types other than the micro droplets may be corrected such that the voltage application timings of the driving signals for these other droplets are retarded by two voltage application cycle periods worth. That is, as long as correction is made so that the voltage application timing of the driving signal for the micro droplets becomes relatively early by two voltage application cycle periods worth, it does not matter which correction method is adopted.

Here, explanation was given in the present exemplary embodiment of an example of the correction of ejection data based on differences in impact time between plural droplet types. However, the time from voltage application of the driving signal to the piezo elements, to adherence of the ink droplets to the paper after ejection of the ink droplets from the nozzles 2 (here this is called ejection time) may be derived, and correction of ejection data may be carried out based on the ejection time differences between plural types of ink. As has been stated above, because in the present exemplary embodiment the timing for rising up of the pulse for the first application of the voltage (first pulse) within the voltage application cycle period is the same for each of the driving signals, the time from application of each of the driving signals up to ejection of the ink droplets is the same for each of the driving signals. Accordingly, because the differences in impact time are equivalent to the differences in ejection time, it does not matter which is used.

Further, in the present exemplary embodiment, explanation has been given of where the controller 18 of the droplet ejection apparatus 10 generates ejection data with corrected voltage application timing and output to the drive unit 16, however, the invention is not limited to this. The ejection data with corrected voltage application timing may be generated at the PC 30 side and output to the droplet ejection apparatus 10. In such a case, the program for generating/correcting ejection data and position alignment correction data that are stored in memory 20 is stored in a memory unit of the PC 30.

Second Exemplary Embodiment

Because of manufacturing variations and the like in the head 14, even though the same driving signal is applied, the droplet volume of the ink droplets for ejection may show variation depending on the characteristics of each of the nozzles 2 (each of the droplet ejectors 24).

Figure 16A:
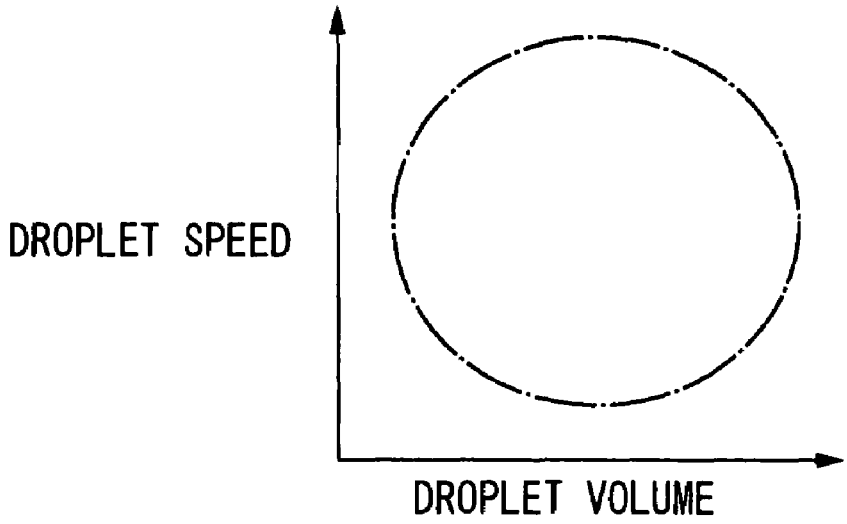
FIG. 16A is a graph showing a case when there is no correlation between droplet volume and droplet speed, and they vary independently.
Figure 16B:
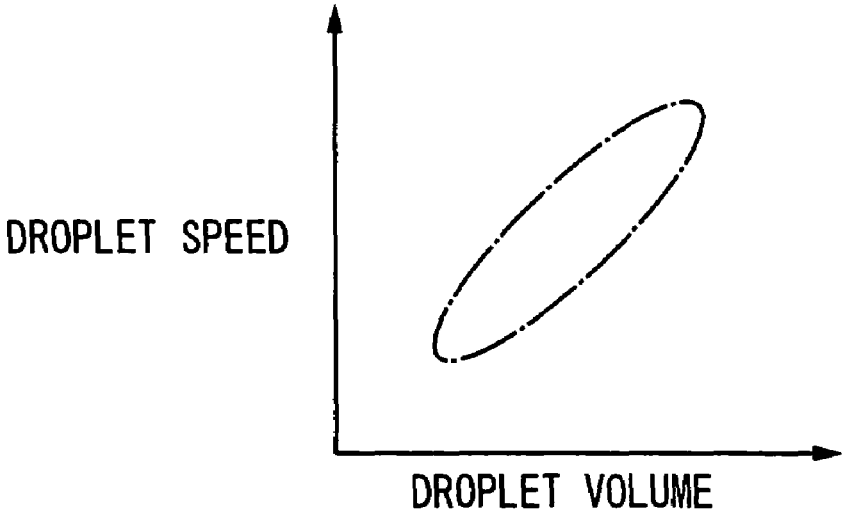
FIG. 16B is a graph showing a case when there is a correlation between the droplet volume and the droplet speed.

The variation in droplet volume and droplet speed of each of the nozzles 2 are not independent variations in droplet volume and droplet speed as shown in FIG. 16A, but it is known that they have a correlation as shown in FIG. 16B. The main factor in ejection variations due to manufacturing of the droplet ejectors 24 is the energy conversion efficiency of the piezoelectric elements 7, and there is a positive correlation relationship between variations in droplet volume and the droplet speed. That is, in the same way as explained in the first exemplary embodiment, when the droplet volume of the ink droplets ejected from the nozzles 2 becomes larger, the droplet speed of the ink droplets becomes faster.

It follows that, in the present exemplary embodiment of a droplet ejection apparatus, correction is made for the variation in the droplet volume of each of the nozzles 2 (each of the droplet ejectors 24), further, in the state in which the droplet volume has been corrected for, correction is made of the voltage application timing of the driving signals to correct the impact position misalignment of the ink droplets, preventing a deterioration in the image quality. Here, the droplet ejection apparatus of the present exemplary embodiment is the same as in the example of the droplet ejection apparatus 10 in the first exemplary embodiment and so explanation thereof will be omitted.

In the first exemplary embodiment an example is described in which for each of the ink droplets of size large droplets, medium droplets, small droplets and micro droplets, a single driving signal is provided. However, in the present exemplary embodiment, for each of the droplet types there are plural types of driving signals used. To be specific, for each of the droplet types there are plural types of driving signals provided that have different driving waveform amplitudes [(HV1-GND) and (HV2-HV1)] according to their rank.

For example, as shown in FIG. 17, three types (three ranks) of driving waveforms for ejecting large droplets, and four types (four ranks) of driving waveforms for ejecting each of medium droplets, small droplets and micro droplets are provided. By selecting the waveform of the rang that is optimal for each of the droplet types according to the ejection characteristics of the droplet ejectors 24, ejection of ink droplets without variation in the droplet volume may be made.

Here, the waveform data for the generation of the driving signals of each of the waveforms is stored in the memory 20. Also, information, corresponding to each of the droplet ejectors 24, on which waveform data is to be used for each droplet type for the ejection of the ink droplets is also stored in memory 20.

Specifically, after manufacturing and before shipping, and after shipping at each of preplanned intervals, by reading in with a scanner test charts, and by applying each of the waveforms to eject ink droplets from each of the droplet ejectors 24, the volume of the droplets may be investigated. Then the driving signal for ejecting ink droplets that is nearest to reference droplet volumes is stored corresponded against identification data for identification of each of the droplet ejectors 24. Accordingly, the optimum driving signal for plural droplet ejectors 24 may easily, and in a short time, be determined and used.

By such storing in the memory 20, the appropriate waveform may easily be selected to correspond to manufacturing variations of the droplet ejectors 24, and the appropriate electrical voltage may be applied to the piezoelectric elements 7.

Now, with reference to FIG. 5, explanation will be given of the generation of ejection data/output processing that is executed in the controller 18 of the droplet ejection apparatus 10 of the present exemplary embodiment.

First, as in the first exemplary embodiment, in Step 100 of FIG. 5, the image data received from the PC 30 is read in, and in Step 102 the droplet type for forming each of the pixels is determined from the gradation values of each of the pixels constructing the image data.

Then in Step 104 determination is made for each of the pixels which volume of droplet from large droplets, medium droplets, small droplets and micro droplets, is to be used for causing ejection of the ink droplet. Here, a selection signal for selecting the driving signal for causing ejection of the ink droplet is generated as ejection data, and the ejection data is generated such that the driving signal stored and corresponded against the identification data for identifying the droplet ejector 24 is selected and generated.

Then, as in the Step 106 above, sorting of the ejection data according to the arrangement of the nozzles 2 is carried out, and in Step 108, the ejection data corrected and sorted as above is output to the drive unit 16 and printed.

Accordingly, the optimum driving signal may be selected in the selector 46 of the drive unit 16, and applied with the optimal voltage application timing to the piezoelectric element 7.

Third Exemplary Embodiment

Because ink decreases in viscosity at high temperature, ink droplets are easily flighted, and there is a tendency for the droplet volume and droplet speed to increase.

Figure 18A:
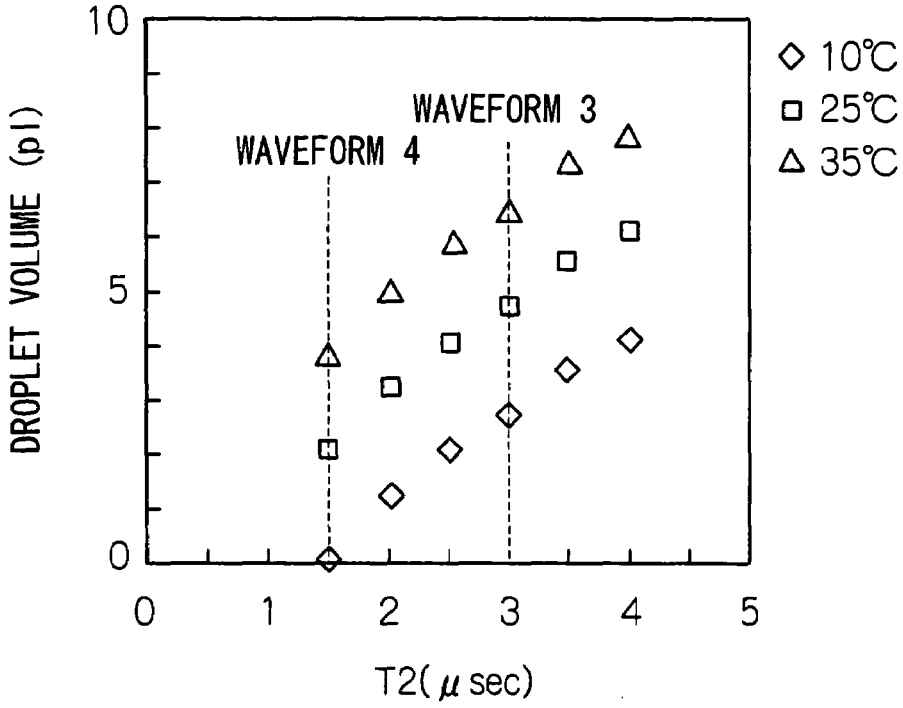
FIG. 18A is an example of a graph showing measurements of droplet volume with parameters of temperature of the ink in pressure chamber 4 of a droplet ejector and driving signals T2 for the waveforms 3 and 4 in FIGS. 11A to 11D and FIG. 12.
Figure 18B:
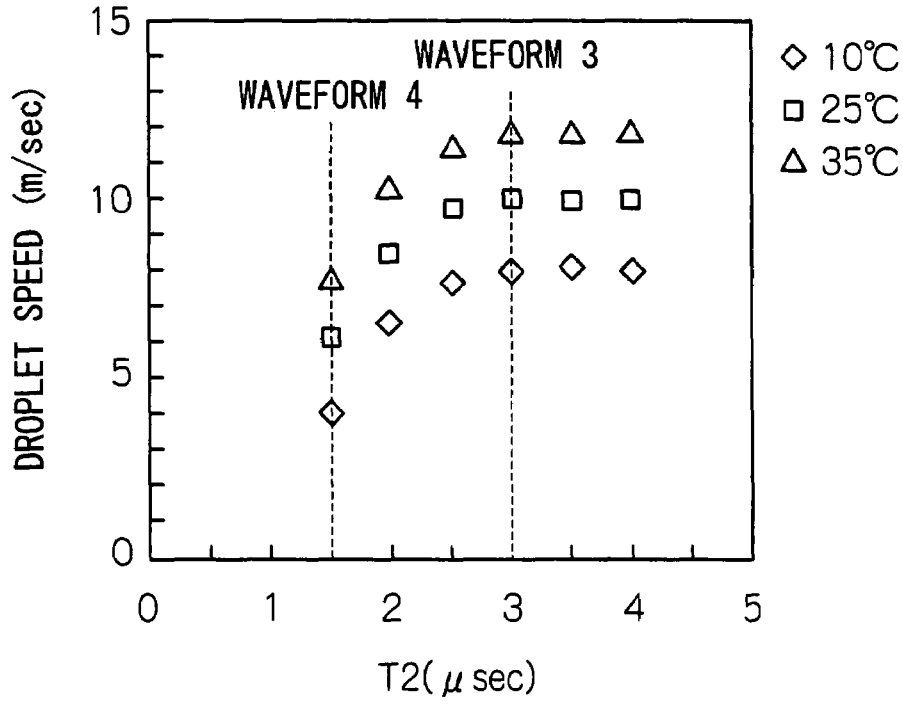
FIG. 18B is an example of a graph showing droplet speed with the same parameters of temperature of the ink in pressure chamber 4 of a droplet ejector 24 and driving signals T2 for the waveforms 3 and 4 in FIGS. 11A to 11D and FIG. 12.

FIG. 18A is an example of a graph of the droplet volumes measured for parameters of temperatures of pressure chambers 4 of the droplet ejectors 24 and pulse intervals T2 for driving signals of the waveform 3 and waveform 4 of FIGS. 11A to 11D, and FIG. 12. FIG. 18B is an example of a graph of the droplet speeds measured for the parameters of temperatures of pressure chambers 4 of the droplet ejectors 24 and pulse intervals T2 for driving signals of the waveform 3 and waveform 4 of FIGS. 11A to 11D, and FIG. 12. As is clear from the graphs, with an increase in temperature of the ink of the pressure chamber 4 from 10° C., 25° C., to 35° C., the droplet volume and droplet speed increases.

That is, in the present exemplary embodiment, since the droplet volume changes along with changes in the ink temperature, and with this the droplet speed changes, correction is made of the driving signal according to the temperature, and in the state in which the droplet volume has been corrected in this way the voltage application timing is corrected for the driving signal, the droplet impact position misalignment is corrected and deterioration in the quality of the images is prevented.

In the droplet ejection apparatus of the present exemplary embodiment, a sensor (not illustrated) is provided for detecting the temperature of the ink in the pressure chamber 4 for each of the droplet ejectors 24 or for each group of droplet ejectors 24 that have been grouped together. The other structures of the droplet ejection apparatus of the present exemplary embodiment are the same as the droplet ejection apparatus 10 shown in the first exemplary embodiment and so explanation thereof is omitted.

In the present exemplary embodiment, in the same way as in the second exemplary embodiment, plural types of driving signal are provided for each type of droplet. In the present exemplary embodiment, plural types of driving waveform are provided with each droplet type having plural types of driving signals that have different driving waveform amplitudes [(HV1-GND) and (HV2-HV1)].

The waveform data for generation of each driving signal of the waveforms is stored in the memory 20. Further, which of the waveform data is to be used for causing ejection of the ink droplets for each of the droplet types, according to the temperature, is stored in the memory 20. Specifically, in the same way as in the second exemplary embodiment, by carrying out tests such as after manufacturing and before shipping, the driving signal for the optimum waveform for each of the droplet types according to the temperature is derived, and this is corresponded with the temperature and stored in the memory 20.

Now, with reference to FIG. 5, explanation will be given of ejection data generation/output processing that is executed in the controller 18 of the droplet ejection apparatus 10 of the present exemplary embodiment.

First, as in the first exemplary embodiment, in Step 100 of FIG. 5, the image data received from the PC 30 is read in, and in Step 102 the droplet type for forming each of the pixels is determined from the gradation values of each of the pixels constructing the image data. Then a selection signal for selecting the driving signal for causing ejection of the ink droplet is generated, as ejection data. Here, ejection data is generated such that the driving signal corresponding to the current temperature of the ink in the pressure chamber 4 detected by the sensor, provided for each of the above droplet ejectors 24 or for each of the groups, is selected and generated. Further, in Step 104, when the ejection data is ejection data for selecting the driving signal for micro droplets, correction is made such that ejection is advanced by two cycles worth of the voltage application cycle period.

Then, as in the Step 106 above, sorting of the ejection data according to the arrangement of the nozzles 2 is carried out, and in Step 108, the ejection data corrected and sorted as above is output to the drive unit 16 and printing is carried out.

Accordingly, the optimum driving signal may be selected in the selector 46 of the drive unit 16, and applied with the optimal voltage application timing to the piezoelectric element 7.

In this way, correction may be made of temperature dependent droplet volume and droplet speed, by changing the driving signal according to the temperature, and even if the temperature changes, uniform droplet volumes and droplet speeds may be maintained.

Here, explanation was given of an example of providing a sensor for detecting the temperature of ink in the pressure chamber 4 for each droplet ejectors 24 or for each group of plural individual droplet ejectors 24 that have been grouped together. However, a sensor for detecting the temperature of the environment outside of the pressure chambers 4, rather than inside of the pressure chambers 4, may be provided, and the result of the detection of this sensor may be taken as indicating the temperature of the ink inside the pressure chambers 4.

Further, here, a sensor is provided for each droplet ejector or for each group thereof for detecting the temperature inside of the pressure chambers 4, however, the invention is not limited to this. A single sensor may be provided.

Fourth Exemplary Embodiment

In the above first to third exemplary embodiments, explanation was given of examples in which after subtracting from the impact time difference to a reference droplet a misalignment amount of a integer multiple of the voltage application cycle period for a remainder amount of ½ a voltage application cycle period or less, even though there is still misalignment in impact position of the remainder portion, because this misalignment amount is small and of a level that does not stand out, no correction of this remainder portion is carried out.

In the present exemplary embodiment, explanation will be given of making the impact time difference even smaller, by correcting the voltage application timing of the driving signal by units of the voltage application cycle period by correcting the ejection data, together with correcting within the voltage application cycle period remaining portions of ½ the voltage application cycle period or less.

Here, correcting within the voltage application cycle period is undertaken by shifting the voltage application timing of the first pulse of the driving signal for the piezoelectric elements 7, rather than correcting the ejection data. When the driving signal for correction has a waveform that continues after the first pulse with a pulse interval T2 and a second pulse, then the whole of the waveform is shifted in the same way.

For example, for the examples of micro droplets shown in FIGS. 15A and 15B of the first exemplary embodiment, the difference in the impact time to the reference droplet is two cycles worth of the voltage application cycle period (111.2 μsec)+ a remainder portion of 2.4 μsec, the ejection data for the micro particles is not simply corrected by two cycles worth of the voltage application cycle period, but the driving signal of the micro droplets is also corrected to provide a driving signal that has a first pulse that is applied with a voltage application timing that is 2.4 μsec earlier than that of a standard driving signal for a micro droplet. That is, the generation data for generating the driving signal adjusted by the remainder portion is stored in advance, and then the waveform signal for the micro droplets is generated using the generation data. Accordingly, misalignment in the impact positions may be made even less visible.

By shifting the timing by the remaining portion, when the waveform of the driving signal straddles the boundary of the continuous voltage application cycle period, the waveform data for generating the driving signal is adjusted in advance so that the boundary is not straddled.

Figure 19A:
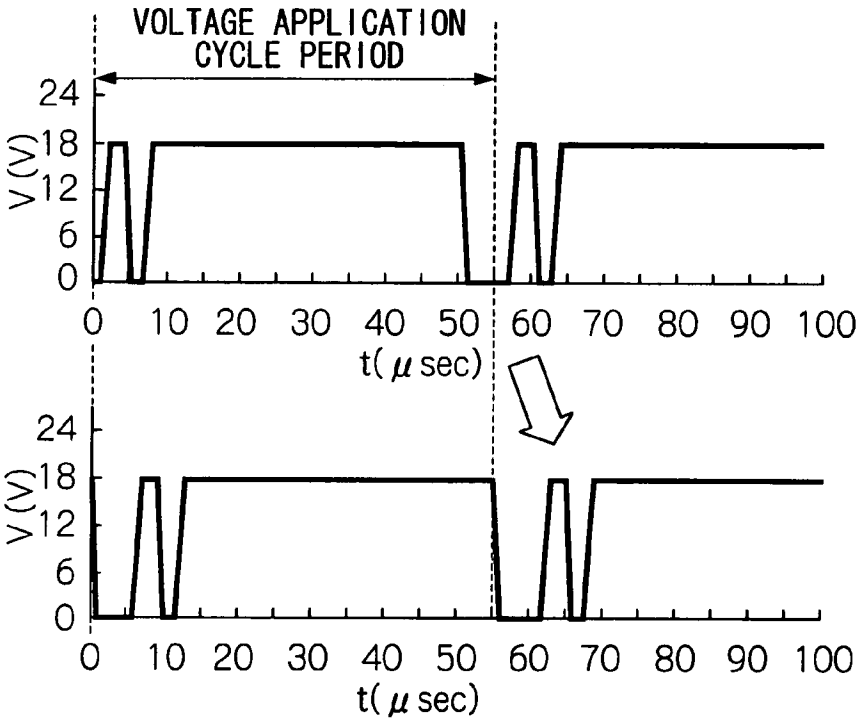
FIGS. 19A to 19B are explanatory diagrams to explain correction methods in cases when there are waveforms of the driving signals that straddle the boundary of continuous applied voltage cycles.
Figure 19B:
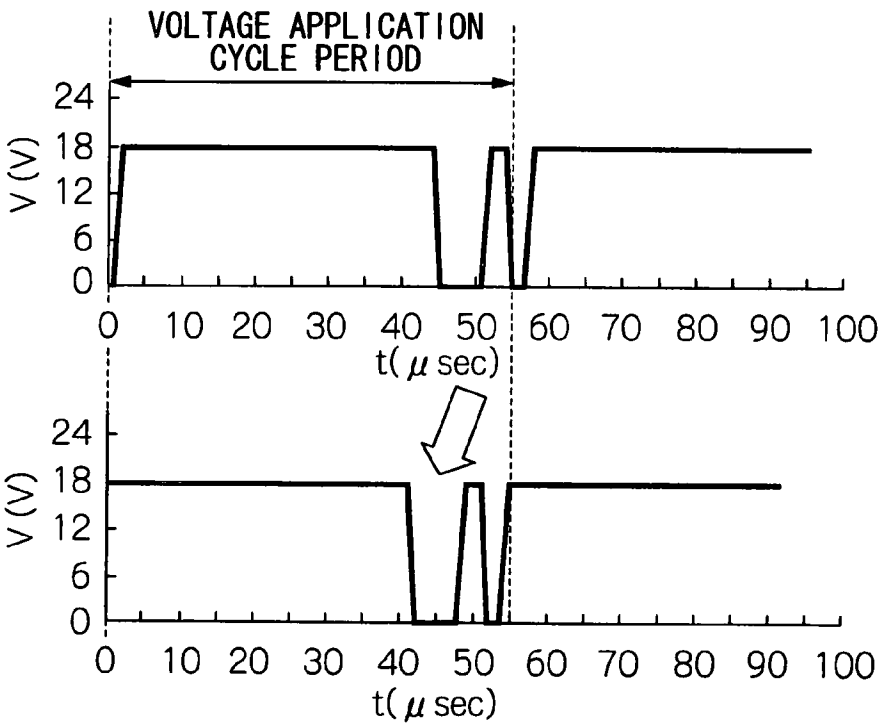

For example, when the amount of movement is small in the movement of the voltage application timing at the side of the following of two voltage application cycle periods then, as shown in FIG. 19A, waveform data is generated so that the voltage application timing of the driving signal is contained within the following voltage application cycle period side, such that the waveform does not straddle the boundary. Further, when the amount of movement is small in the movement of the voltage application timing at the side of the proceeding of two voltage application cycle periods then, as shown in FIG. 19B, waveform data is generated so that the voltage application timing of the driving signal is contained within the proceeding voltage application cycle period side, such that the waveform does not straddle the boundary.

Still further, by such shifting of the voltage application timing of the first pulse by the remaining portion, when the waveform of the driving signal falls into either the proceeding or following voltage application cycle periods, adjustment is necessary of the correction by integer amounts of the voltage application cycle period of the ejection data in accordance with the shifts.

Rather than correcting the driving signal of the micro droplets, the other driving signals may be corrected such that the voltage application timing of the driving signal of the micro droplets becomes relatively early compared to that of the voltage application timings for the other driving signals. In this case, in the same way, for the other driving signals corrected driving signals may be prepared, so that they may be generated in the drive unit 16.

Explanation has been given in the above second exemplary embodiment of an example in which correction is made of voltage application timing of driving signals whilst suppressing variations in droplet volume and droplet speed due to variations in the ejection characteristics of the droplet ejectors 24 by generating driving signals according to these ejection characteristics, and in the third exemplary embodiment explanation has been given of an example in which correction has been made of voltage application timing of driving signals whilst suppressing variations in droplet volume and droplet speed due to variations in temperature of the ink by generating driving signals according to the temperature of the ink in the pressure chambers 4. However, an appropriate driving signal may be generated according to both the ejection characteristics of the droplet ejectors 24 and the temperature of the ink in the pressure chamber 4, such that correction of the voltage application timing may be made by suppressing variations in the droplet volume and droplet speed.

Further, in the above first to fourth exemplary embodiments, examples where given in which the medium onto which the droplets are ejected is paper. However, there are no particular limitations for this medium and OHP sheets and the like may be used.

Further, in the above first to fourth exemplary embodiments, examples where given in which ink droplets where ejected, however, the present invention is not limited to this, and the droplets ejected may be droplets of a processing liquid, such as an curing promoter for ink droplets or the like. Further, application may also be made of this invention, in the same way as above, to inkjet methods for coating oriented film forming materials of liquid crystal display elements, coating of glass, coating of adhesives and the like.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. A droplet ejection apparatus comprising:

an ejecting unit provided with plural droplet ejection portions, each droplet ejection portion comprising:

a pressure chamber containing a liquid;

an ejecting portion communicating with the pressure chamber and ejecting droplets according to changes in pressure in the pressure chamber; and a driving element that changes the pressure in the pressure chamber according to a driving signal applied thereto and causes the ejecting portion to eject the droplets of a droplet volume in accordance with the applied driving signal;

a driving unit generating the driving signal according to ejection data and applying the generated driving signal with a predetermined voltage application cycle period to the driving elements; and a correcting unit that corrects the ejection data such that a voltage application timing of the driving signal for the driving elements is corrected by an integer multiple of a voltage application cycle period according to a time difference of ejection times when, between a plurality of droplets of different droplet volumes which are ejected to a medium onto which the droplets are ejected, a difference of the ejection times, from ejection of the droplets from the ejecting portion until adhering of the droplets to the medium, or from application of the driving signal to the driving elements and the ejecting portion ejecting the droplets until adhering of the droplets to the medium, exceeds ½ the voltage application cycle period.

2. The droplet ejection apparatus according to claim 1, wherein the correcting unit corrects the ejection data such that when the voltage application timing of the driving signal which is applied to a target driving element and is corrected by the multiple of the voltage application cycle period is coincident with a voltage application timing of another driving signal for the target driving element, one or other of the driving signals is given preference and applied to the target driving element.

3. The droplet ejection apparatus according to claim 2, wherein the ejection data is corrected such that the driving signal of the droplets that have a larger volume is given preference and applied to the target driving element.

4. The droplet ejection apparatus according to claim 1, wherein the driving signal comprises a first pulse that expands the pressure chamber and contracts the pressure chamber to eject a droplet, and a second pulse applied after the first pulse that does not eject the droplet; and the correcting unit corrects the ejection data such that the voltage application timing of the driving signal that has a pulse interval between the first pulse and the second pulse that is shorter than a predetermined value is made earlier relative to the voltage application timing of another driving signal by the integer multiple of the voltage application cycle period.

5. The droplet ejection apparatus according to claim 1, wherein the correcting unit further corrects the ejection data such that the driving signal is corrected and applied such that variations in the droplet volumes due to variations in the droplet ejection characteristics of each of the droplet ejection portions are substantially eliminated.

6. The droplet ejection apparatus according to claim 5, wherein the driving unit generates a plurality of driving signals for each of the droplet volumes, and selects and applies a driving signal for each of the driving elements of the droplet ejection portions from the plurality of driving signals according to the ejection data; and the correcting unit corrects the ejection data such that the driving signal is selected and applied from the plurality of driving signals according to the droplet ejection characteristics of each of the droplet ejection portions.

7. The droplet ejection apparatus according to claim 1, further comprising a detection unit detecting a temperature of the liquid contained in the pressure chamber, wherein the correcting unit further corrects the ejection data such that the driving signal is corrected and applied based on the temperature detected by the detection unit such that variations in the droplet volumes due to variations in the temperature of the liquid contained in the pressure chamber are substantially eliminated.

8. The droplet ejection apparatus according to claim 7, wherein the driving unit generates a plurality of driving signals for each of the droplet volumes, and selects and applies a driving signal for each of the driving elements of the droplet ejection portions from the plurality of driving signals according to the ejection data; and the correcting unit corrects the ejection data such that the driving signal is selected and applied from the plurality of driving signals according to the temperature detected by the detecting unit.

9. The droplet ejection apparatus according to claim 1, further comprising a control unit controlling the driving unit such that the driving signal is adjusted and generated such that an ejection timing of a droplet is shifted by an amount that is a time remaining after subtracting a correction amount of the integer multiple of the voltage application cycle period from a difference in time between the ejection time of the droplet of a droplet volume ejected by the driving signal for correction and the ejection time of the droplet of a reference droplet volume.

10. The droplet ejection apparatus according to claim 1, wherein the ejection data is corrected such that the voltage application timing of the driving signal for the smallest of the droplet volumes is made earlier relative to the voltage application timing of the another driving signal by the integer multiple of the voltage application cycle period.

11. The droplet ejection apparatus according to claim 1, further comprising a memory storing data for correcting the ejection data for each of the droplet volumes, wherein the ejection data is corrected by using data read in from the memory.

12. The droplet ejection apparatus according to claim 1, wherein a relative position between the plurality of droplet ejection portions and the medium is changed by conveying the medium.

13. A droplet ejection control apparatus comprising:

a correcting unit that corrects the ejection data such that a voltage application timing of a driving signal for driving elements is corrected by an integer multiple of a predetermined voltage application cycle period according to a time difference of ejection times when, between a plurality of droplets of different droplet volumes which are ejected to a medium onto which the droplets are ejected, a difference of the ejection times, from ejection of the droplets from the ejecting portion until adhering of the droplets to the medium, or from application of the driving signal to the driving elements and the ejecting portion ejecting the droplets until adhering of the droplets to the medium, exceeds ½ the voltage application cycle period, when ejecting the droplets onto the medium by using:

an ejecting unit provided with plural droplet ejection portions, each droplet ejection portion comprising:

a pressure chamber containing a liquid;

an ejecting portion communicating with the pressure chamber and ejecting the droplets according to changes in pressure in the pressure chamber; and the driving element that changes the pressure in the pressure chamber according to the driving signal applied thereto and causes the ejecting portion to eject the droplets of a droplet volume in accordance with the applied driving signal; and a driving unit generating the driving signal according to the ejection data and applying the generated driving signal with the predetermined voltage application cycle period to the driving elements.

14. The droplet ejection control apparatus according to claim 13, wherein the correcting unit corrects the ejection data such that when the voltage application timing of the driving signal which is applied to a target driving element and is corrected by the integer multiple of the voltage application cycle period is coincident with a voltage application timing of another driving signal for the target driving element, one or other of the driving signals is given preference and applied to the target driving element.

15. The droplet ejection control apparatus according to claim 13, wherein the driving signal comprises a first pulse that expands the pressure chamber and contracts the pressure chamber to eject a droplet, and a second pulse applied after the first pulse that does not eject a droplet; and the correcting unit corrects the ejection data such that the voltage application timing of the driving signal that has a pulse interval between the first pulse and the second pulse that is shorter than a predetermined value is made earlier relative to the voltage application timing of another driving signal by the integer multiple of the voltage application cycle period.

16. The droplet ejection control apparatus according to claim 13, wherein the correcting unit further corrects the ejection data such that the driving signal is corrected and applied such that variations in the droplet volumes due to variations in the droplet ejection characteristics of each of the droplet ejection portions are substantially eliminated.

17. The droplet ejection control apparatus according to claim 13, wherein the correcting unit further corrects the ejection data such that the driving signal is corrected and applied based on a temperature in the pressure chamber such that variations in the droplet volumes due to variations in the temperature of the liquid contained in the pressure chamber are substantially eliminated.

18. The droplet ejection control apparatus according to claim 13, further comprising a control unit controlling the driving unit such that the driving signal is adjusted and generated such that an ejection timing of a droplet is shifted by an amount that is a time remaining after subtracting a correction amount of the integer multiple of the voltage application cycle period from a difference in time between the ejection time of the droplet of a droplet volume ejected by the driving signal for correction and the ejection time of the droplet of a reference droplet volume.

19. A droplet ejection method comprising:

correcting ejection data such that a voltage application timing of a driving signal for driving elements is corrected by an integer multiple of a predetermined voltage application cycle period according to a time difference of ejection times when, between a plurality of droplets of different droplet volumes which are ejected to a medium onto which the droplets are ejected, a difference of the ejection times, from ejection of the droplets from the ejecting portion until adhering of the droplets to the medium, or from application of the driving signal to the driving elements and the ejecting portion ejecting the droplets until adhering of the droplets to the medium, exceeds ½ the voltage application cycle period, when generating the driving signal according to ejection data and applying the generated ejection data with the voltage application cycle period to each of the driving elements of an ejecting unit comprising:

plural pressure chambers containing a liquid;

ejecting portions communicating with the pressure chambers and ejecting the droplets according to changes in pressure in the pressure chamber; and the driving elements that change the pressure in the pressure chambers according to the driving signal applied thereto and cause the ejecting portions to eject the droplets of a droplet volume in accordance with the applied driving signal.

* * * * *